US010910718B2

(12) United States Patent
Yashiro et al.

(10) Patent No.: US 10,910,718 B2
(45) Date of Patent: Feb. 2, 2021

(54) TRANSPARENT ANTENNA AND TRANSPARENT ANTENNA-ATTACHED DISPLAY DEVICE

(71) Applicant: Sharp Kabushiki Kaisha, Sakai (JP)

(72) Inventors: Yuhji Yashiro, Sakai (JP); Hiroyuki Ogawa, Sakai (JP); Yasuhiro Sugita, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 623 days.

(21) Appl. No.: 15/536,487

(22) PCT Filed: Dec. 15, 2015

(86) PCT No.: PCT/JP2015/085042

§ 371 (c)(1),
(2) Date: Jun. 15, 2017

(87) PCT Pub. No.: WO2016/098763

PCT Pub. Date: Jun. 23, 2016

(65) Prior Publication Data

US 2017/0373397 A1 Dec. 28, 2017

(30) Foreign Application Priority Data

Dec. 18, 2014 (JP) ..... 2014-256436

(51) Int. Cl.

| | |
|---|---|
| ***H01Q 1/44*** | (2006.01) |
| ***H01Q 9/04*** | (2006.01) |
| ***H01Q 21/08*** | (2006.01) |
| ***H01Q 1/38*** | (2006.01) |
| ***H01Q 1/24*** | (2006.01) |
| ***H01Q 1/36*** | (2006.01) |
| ***H01Q 1/40*** | (2006.01) |

(52) U.S. Cl.

CPC ..... *H01Q 9/0407* (2013.01); *H01Q 1/243* (2013.01); *H01Q 1/36* (2013.01); *H01Q 1/38* (2013.01); *H01Q 1/40* (2013.01); *H01Q 1/44* (2013.01); *H01Q 21/08* (2013.01)

(58) Field of Classification Search

CPC ..... H01Q 1/243; H01Q 9/0407; H01Q 7/00; H01Q 9/04; H01Q 1/22–1/44

See application file for complete search history.

(56) References Cited

U.S. PATENT DOCUMENTS

| | | | | |
|---|---|---|---|---|
| 6,317,099 | B1 * | 11/2001 | Zimmerman | H01Q 1/246 343/747 |
| 6,525,694 | B2 * | 2/2003 | Jiang | H01Q 1/38 343/700 MS |
| 7,079,079 | B2 * | 7/2006 | Jo | H01Q 1/243 343/700 MS |

(Continued)

FOREIGN PATENT DOCUMENTS

| | | |
|---|---|---|
| JP | 4814223 B | 11/2011 |

*Primary Examiner* — Hasan Z Islam

(74) *Attorney, Agent, or Firm* — ScienBiziP, P.C.

(57) ABSTRACT

A transparent antenna 17 is provided with: an antenna body portion 18 having a ring-shape and configured to generate a magnetic field at the center thereof; a lead-out wire portions 19 led out of the antenna body portion 18, the lead-out wire portions 19 including a large-width portions 23 having a line width greater than a line width of the antenna body portion 18.

9 Claims, 24 Drawing Sheets

(56) References Cited

U.S. PATENT DOCUMENTS

| | | | | |
|---|---|---|---|---|
| 7,712,672 | B2 * | 5/2010 | Takahashi | G06K 7/10336 235/492 |
| 8,466,791 | B2 * | 6/2013 | Goto | H01Q 7/00 340/572.7 |
| 10,256,540 | B2 * | 4/2019 | An | H01Q 1/2225 |
| 2003/0142018 | A1 * | 7/2003 | Lange | H01Q 1/007 343/700 MS |
| 2009/0051620 | A1 | 2/2009 | Ishibashi et al. | |
| 2009/0140938 | A1 | 6/2009 | Ishibashi et al. | |
| 2010/0302039 | A1 * | 12/2010 | Goto | H01Q 7/00 340/572.7 |
| 2013/0002510 | A1 * | 1/2013 | Azulay | H01Q 1/243 343/860 |
| 2015/0318609 | A1 * | 11/2015 | Tomonari | H01Q 7/00 343/788 |
| 2017/0133744 | A1 * | 5/2017 | An | H01Q 1/2291 |

* cited by examiner

TRANSPARENT ANTENNA AND TRANSPARENT ANTENNA-ATTACHED DISPLAY DEVICE

TECHNICAL FIELD

The present invention relates to a transparent antenna and a transparent antenna-attached display device.

BACKGROUND ART

Conventionally, a transparent antenna which is attached to a display screen for communications with an external device and the like is known, as disclosed in Patent Document 1, for example. Patent Document 1 discloses a transparent antenna for a display, the transparent antenna including a sheet-shaped transparent base member having an insulating property, and a planar antenna pattern formed on a surface of the transparent base member. A conductive portion of the antenna pattern is made of a conductive thin film having a mesh structure, outlines of each mesh are constituted from extra-fine bands of substantially equal widths, and the antenna pattern forming portion has a light transmittance of not less than 70%.

PRIOR ART DOCUMENT

Patent Document

Patent Document 1: Japanese Patent No. 4814223

Problems to be Solved by the Invention

The antenna pattern of the transparent antenna disclosed in Patent Document 1 is described as being made of a conductive thin film of a mesh structure. However, in recent years, there has been increasing demands for ever higher antenna performance. In order to satisfy the demand for high antenna performance, the wire resistance of the antenna pattern made of the conductive thin film of a mesh structure cannot be said to be sufficiently low. Furthermore, in addition to a demand for placing the transparent antenna toward the center of the display screen, in recent years, the display screen size has been becoming larger, thus causing an increase in the wire resistance of the transparent antenna. An increase in the wire resistance of the transparent antenna leads disadvantageously to a decrease in the antenna performance of the transparent antenna.

DISCLOSURE OF THE PRESENT INVENTION

The present invention was made in view of the above circumstances. An object of the present invention is to increase antenna performance.

Means for Solving the Problems

A transparent antenna according to the present invention includes an antenna body portion having a ring-shape and configured to generate a magnetic field on an inner side thereof; and a lead-out wire portion led out of the antenna body portion, the lead-out wire portion including a large-width portion having a line width greater than a line width of the antenna body portion.

In this way, when the lead-out wire portion is energized and a current is flowed through the ring-shaped antenna body portion, a magnetic field is generated by electromagnetic induction on the inner side of the antenna body portion. The lead-out wire portion includes the large-width portion having a line width greater than the line width of the antenna body portion. Accordingly, the wire resistance of the transparent antenna can be decreased. Accordingly, the Q-value of the transparent antenna is increased, and an increase in antenna performance can be achieved.

Embodiments of the transparent antenna of the present invention may include the following configurations.

(1) The antenna body portion may have a closed ring-shape to surround a magnetic field generating region on the inner side thereof in which the magnetic field develops. In this way, compared to if the antenna body portion has an open ring-shape, high induced electromotive force can be obtained. Accordingly, higher antenna performance can be obtained.

(2) The large-width portion may include a line width-varying large-width portion having a line width that gradually increases as a distance from the antenna body portion increases. In this way, because the large-width portion constituting the lead-out wire portion led out of the closed ring-shaped antenna body portion includes the line width-varying large-width portion having the line width that gradually increases as a distance from the antenna body portion increases, in comparison to a configuration in which the large-width portion has a constant line width, wire resistance can be preferably decreased while maintaining high induced electromotive force of the antenna body portion.

(3) The antenna body portion may have four side portions that form a quadrilateral ring shape in a plan view. The line width-varying large-width portion is connected with one of the side portions of the antenna body portion. The line width-varying large-width portion may include an inclined large-width portion that is inclined with respect to a direction along the one of the side portions of the antenna body portion. The line width-varying large-width portion of the lead-out wire portion and the side portion of the antenna body portion that is connected with the line width-varying large-width portion may constitute an additional coil. Since the magnetic field generated by the additional coil ("inverse magnetic field") has an opposite direction from the magnetic field generated in the magnetic field generating region on the inner side of the antenna body portion, antenna performance may potentially deteriorate due to the inverse magnetic field. In this respect, the line width-varying large-width portion includes the inclined large-width portion that is inclined with respect to the direction along the side of the antenna body portion. Accordingly, in comparison to a configuration in which the line width-varying large-width portion is configured to extend along the direction perpendicular to the side, the region in which the inverse magnetic field develops becomes narrower and thus the ratio of the inverse magnetic field becomes relatively low. Accordingly, deterioration in antenna performance due to the inverse magnetic field can be reduced.

(4) The transparent antenna may include the lead-out wire portions arranged side by side. The line width-varying large-width portion of one of the plurality of the lead-out wire portions which is disposed at an outermost position may be configured to form an angle of not less than 14 degrees with respect to a direction perpendicular to the side portion of the antenna body portion which is connected with the line width-varying large-width portion. If the angle formed by the line width-varying large-width portion disposed at the outermost position lead-out wire portion with the direction perpendicular to the side portion of the antenna body which is connected with the line width-varying large-width portion is smaller than 14 degrees, the ratio of the inverse magnetic field would become too high, and antenna performance may deteriorate to an unacceptable level. In this respect, when the angle formed by the line width-varying large-width portion disposed at the outermost position lead-out wire portion with respect to the direction perpendicular to the side portion of the antenna body which is connected with the line width-varying large-width portion is not less than 14 degrees, the region in which the inverse magnetic field is generated is made sufficiently narrow, and the ratio of the inverse magnetic field becomes sufficiently low. Accordingly, deterioration in antenna performance due to the inverse magnetic field can be sufficiently reduced.

(5) The lead-out wire portion may be entirely configured from the large-width portion. In this way, compared to if the line width of some of the lead-out wire portions is made the same as the line width of the antenna body portion, a greater area of the lead-out wire portion can be ensured. Accordingly, the wire resistance of the transparent antenna can be decreased more, whereby a further increase in antenna performance can be achieved.

(6) The lead-out wire portion may include at least a first wire portion connected with the antenna body portion, and a second wire portion disposed on an opposite side from the antenna body portion with respect to the first wire portion, and connected with the first wire portion. The first wire portion may have a line width which is the same as a line width of the antenna body portion, and the second wire portion may include the large-width portion. In this way, of the lead-out wire portion, the line width of the first wire portion connected with the closed ring-shape antenna body portion is the same as the line width of the antenna body portion. Accordingly, compared to if the first wire portion includes a large-width portion, the magnetic field generated in the magnetic field generating region of the antenna body portion can become stronger, whereby higher induced electromotive force can be obtained. On the other hand, the second wire portion disposed on the opposite side from the antenna body portion with respect to the first wire portion and connected with the first wire portion includes a large-width portion. Accordingly, wire resistance can be preferably decreased while ensuring the high induced electromotive force obtained with the first wire portion. Accordingly, higher antenna performance can be obtained.

(7) The antenna body portion may have four side portions forming a quadrilateral ring-shaped planar shape. The first wire portion may be connected with one of the side portions constituting the antenna body portion, extend along a direction perpendicular to the side, and have a length dimension of not more than 21 mm. The first wire portion of the lead-out wire portion and the side portion of the antenna body portion which is connected with the first wire portion may constitute an additional coil. The magnetic field generated by the additional coil ("inverse magnetic field") has an opposite direction from the magnetic field generated in the magnetic field generating region on the inner side of the antenna body portion. As a result, antenna performance may potentially deteriorate. In particular, the first wire portion is connected with one of the side portions of the antenna body portion having the quadrilateral ring-shaped planar shape, and extends along a direction perpendicular to the side. Accordingly, compared to if the first wire portion is inclined with respect to the side, the inverse magnetic field tends to become stronger. If the length of the first wire portion is greater than 21 mm, antenna performance due to the inverse magnetic field may deteriorate to an unacceptable level. In this respect, by making the length of the first wire portion not more than 21 mm, the region in which the inverse magnetic field is generated can be made sufficiently narrow, whereby the ratio of the inverse magnetic field becomes sufficiently low. Accordingly, deterioration in antenna performance due to the inverse magnetic field can be sufficiently reduced.

(8) The large-width portion may include a constant line width large-width portion having a constant line width. In this way, because the large-width portion constituting the second wire portion includes the constant line width large-width portion with the constant line width, the space in which the transparent antenna is disposed can be made compact. This is preferable when transparent antennas are arranged side by side.

(9) The transparent antenna may include the lead-out wire portions arranged side by side. The plurality of the lead-out wire portions may have a maximum outer width which is the same as or smaller than a maximum outer width of the antenna body portion. In this way, the space in which the transparent antenna is disposed can be made compact. This is preferable when transparent antennas are arranged side by side.

(10) The antenna body portion and the lead-out wire portion may be made of a meshed metal film, and have planar shapes defined by a slit patterned in the metal film. In this way, wire resistance can be decreased while ensuring the optical transparency of the transparent antenna.

In order to solve the problems, a transparent antenna-attached display device according to the present invention includes the transparent antenna; a transparent antenna substrate provided with the transparent antenna; and a display panel stacked on the transparent antenna substrate, the display panel including a display region configured to display an image and a non-display region circumscribing the display region. The transparent antenna is disposed over the display region.

In this way, by utilizing the transparent antenna disposed over the display region of the display panel, it becomes possible to, for example, perform communication with an external device and the like. It also becomes possible to perform operations such as bringing the external device close to the transparent antenna based on an image displayed in the display region, whereby enhanced convenience of use and the like can be obtained. In addition, because the transparent antenna has sufficiently high antenna performance, communication with the external device and the like can be performed satisfactorily.

Embodiments of the transparent antenna-attached display device according to the present invention may include the following configurations.

(1) The transparent antenna substrate may be provided with an antenna connecting wire portion disposed over the non-display region and connected to the lead-out wire portion. In this way, because the antenna connecting wire portion disposed over the non-display region is connected to the lead-out wire portion, it becomes possible to, for example, configure the antenna connecting wire portion from a light-blocking metal film. Accordingly, the wire resistance of the transparent antenna can be further decreased.

(2) The transparent antenna may be configured such that the antenna body portion includes antenna element wires, and the lead-out wire portions are individually connected to respective ends of the antenna element wires. The antenna connecting wire portion may include a short-circuit wire portion which short-circuits two lead-out wire portions connected to the ends of mutually different antenna element wires. In this way, by short-circuiting, with the short-circuit wire portion, the two lead-out wire portions connected to the ends of mutually different antenna element wires, it becomes possible to flow a current through the antenna element wires respectively connected to the two short-circuited lead-out wire portions. Accordingly, a magnetic field can be generated on the inner side of the antenna body portion.

Advantageous Effect of the Invention

According to the present invention, antenna performance can be increased.

MODE FOR CARRYING OUT THE INVENTION

First Embodiment

Figure 1:
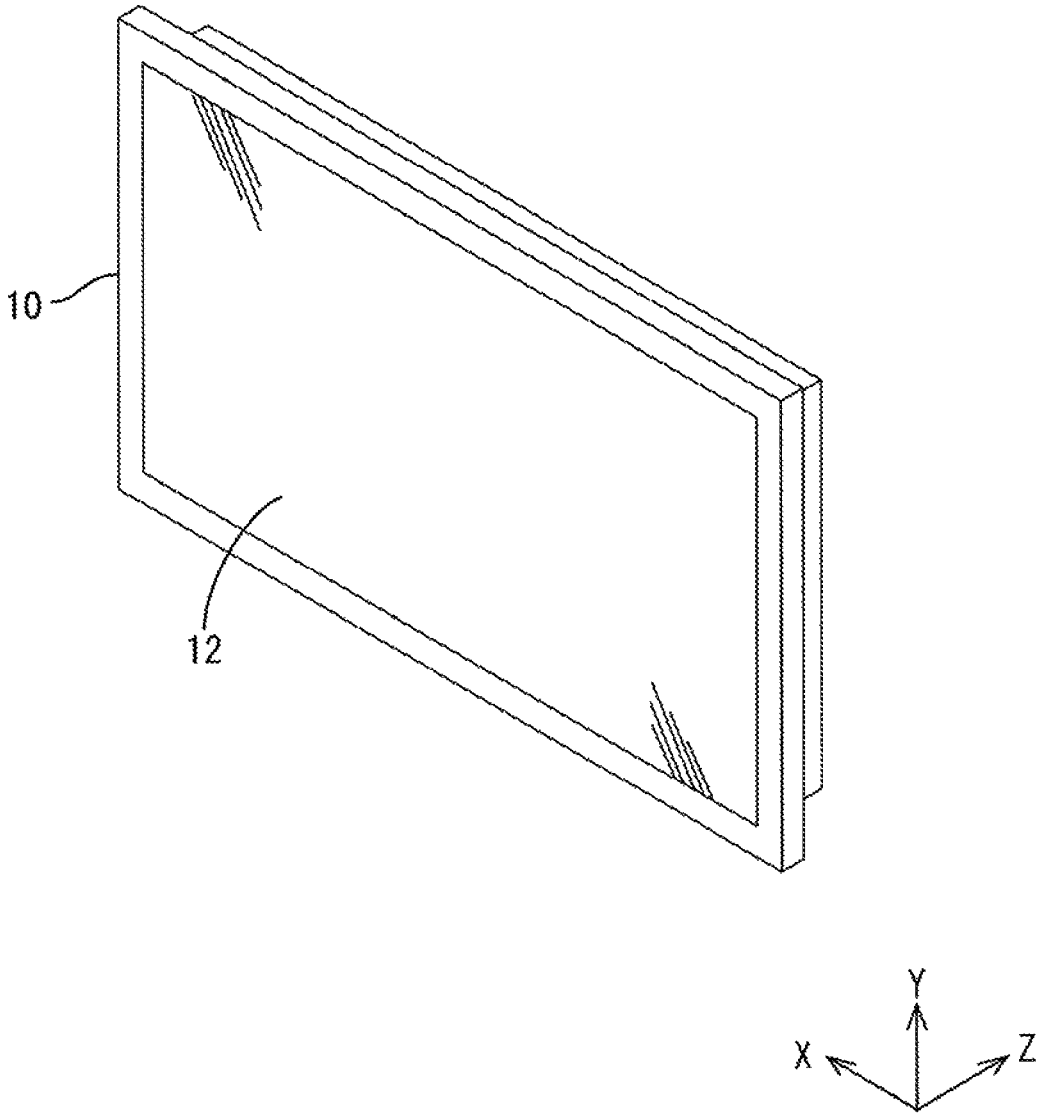
FIG. 1 is a perspective view of a liquid crystal display device according to a first embodiment of the present invention.

A first embodiment of the present invention will be described with reference to FIG. 1 to FIG. 9. In the present embodiment, a transparent antenna-attached liquid crystal display device 10 will be described by way of example, the liquid crystal display device being enabled to perform communication with an external device (not illustrated) via a transparent antenna 17. In some of the drawings, an X-axis, a Y-axis, and a Z-axis are drawn, respectively corresponding to the directions indicated in the drawings.

A configuration of the liquid crystal display device 10 will be described. The liquid crystal display device 10, as illustrated in FIG. 1, is provided with a liquid crystal panel (display panel) 11 for displaying an image; a transparent antenna substrate 12 that is disposed on an outer side (upper side) with respect to and opposing the liquid crystal panel 11 and fitted with a transparent antenna 17; and a back-light device (illumination device) 13 that is an external light source for emitting light toward the liquid crystal panel 11. Of these, the liquid crystal panel 11 and the transparent antenna substrate 12 are stacked so as to oppose each other, with a substantially transparent adhesive layer (not illustrated) interposed therebetween so as to be fixed and integrated with each other. As the adhesive layer, it may be preferable to use an optical clear adhesive (OCA) tape, for example. The liquid crystal display device 10 is also provided with a chassis 14 in which the back-light device 13 is housed; a frame 15 which holds the back-light device 13 with the chassis 14; and a bezel 16 which holds the liquid crystal panel 11 and the transparent antenna substrate 12 with the frame 15.

Figure 4:
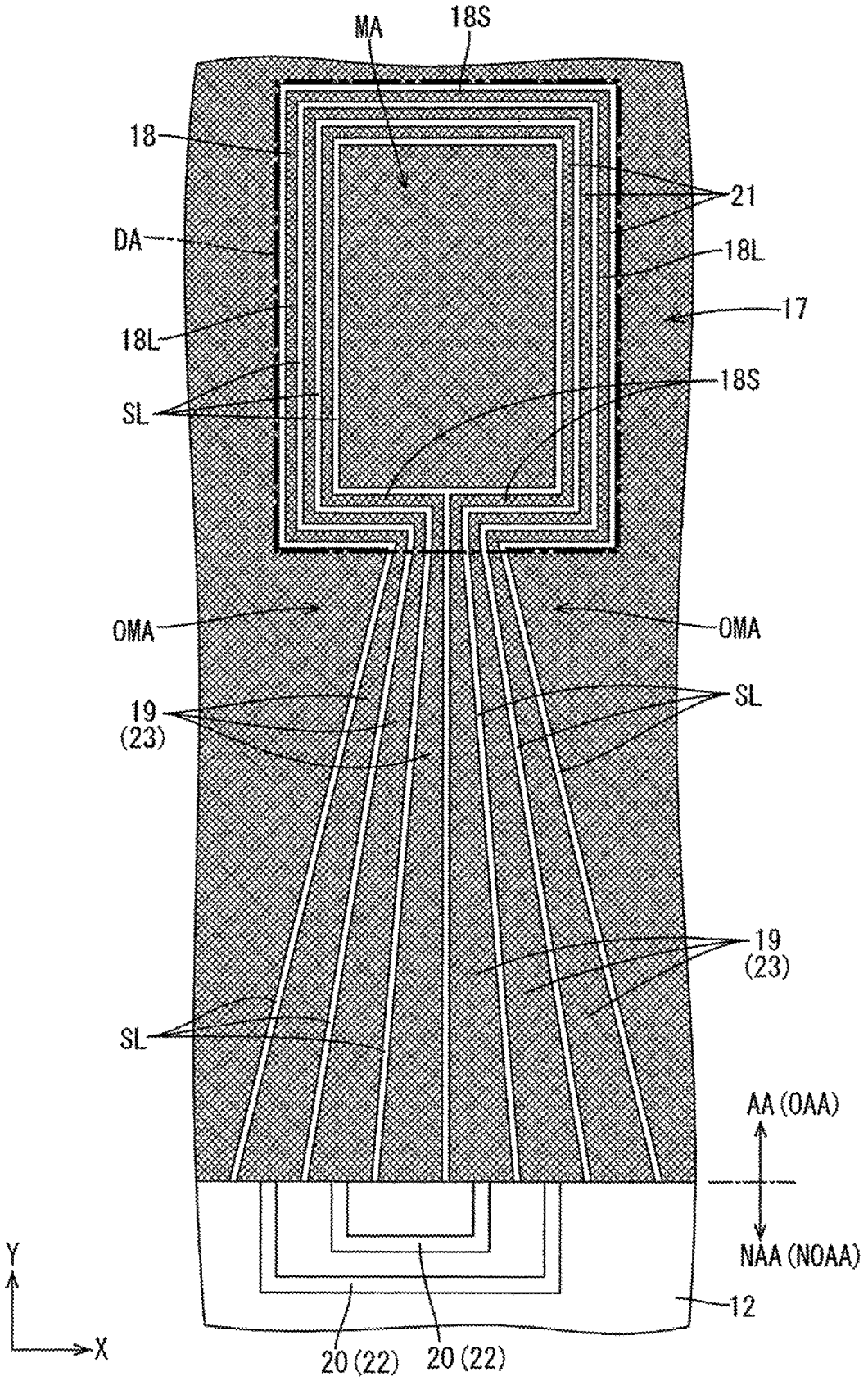
FIG. 4 is a plan view of a transparent antenna.

The liquid crystal display device 10 according to the present embodiment may be used in various electronic devices (not illustrated), such as an information display, an electronic blackboard, and a television receiver device. Accordingly, the liquid crystal panel 11 of the liquid crystal display device 10 has a screen size on the order of 30 inches to 50 inches, which are generally classified as being middle-sized to large-sized. The liquid crystal display device 10 and the external device may preferably communicate with each other using a short-distance wireless communication system, such as Near Field Communication (NFC). Specific examples of the external device which performs short-distance wireless communication with the liquid crystal display device 10 include an IC card and a smartphone each with a built-in device-side antenna DA. A user can conduct short-distance wireless communication between the device-side antenna DA of the external device and the transparent antenna 17 by bringing the external device, such as an IC card or a smartphone, close to the transparent antenna 17 in accordance with a display on the liquid crystal display device 10. In FIG. 4, the outline of the device-side antenna DA is indicated by a dashed-and-dotted line.

Figure 2:
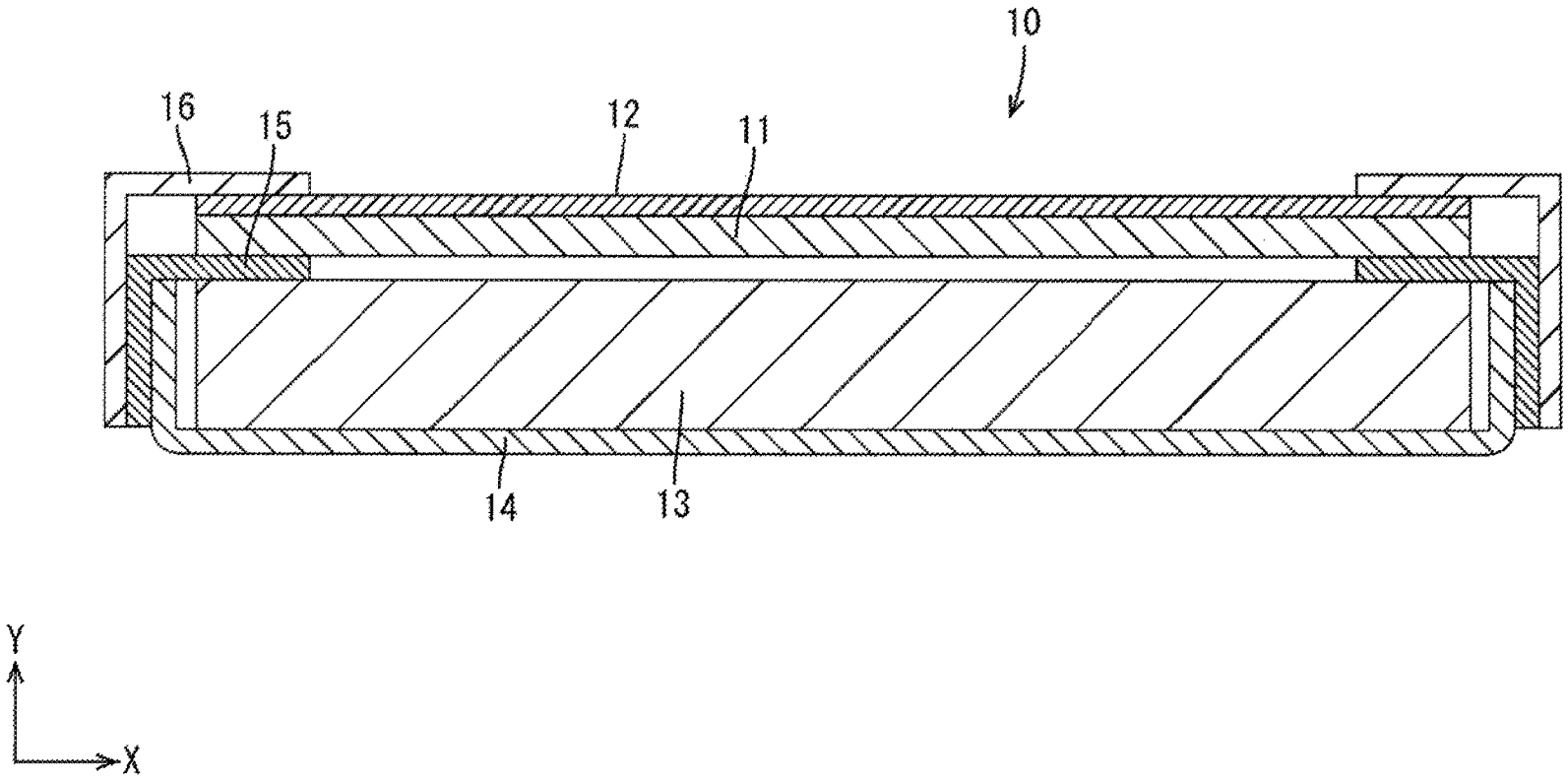
FIG. 2 is a cross sectional view illustrating a schematic configuration of the liquid crystal display device.
Figure 3:
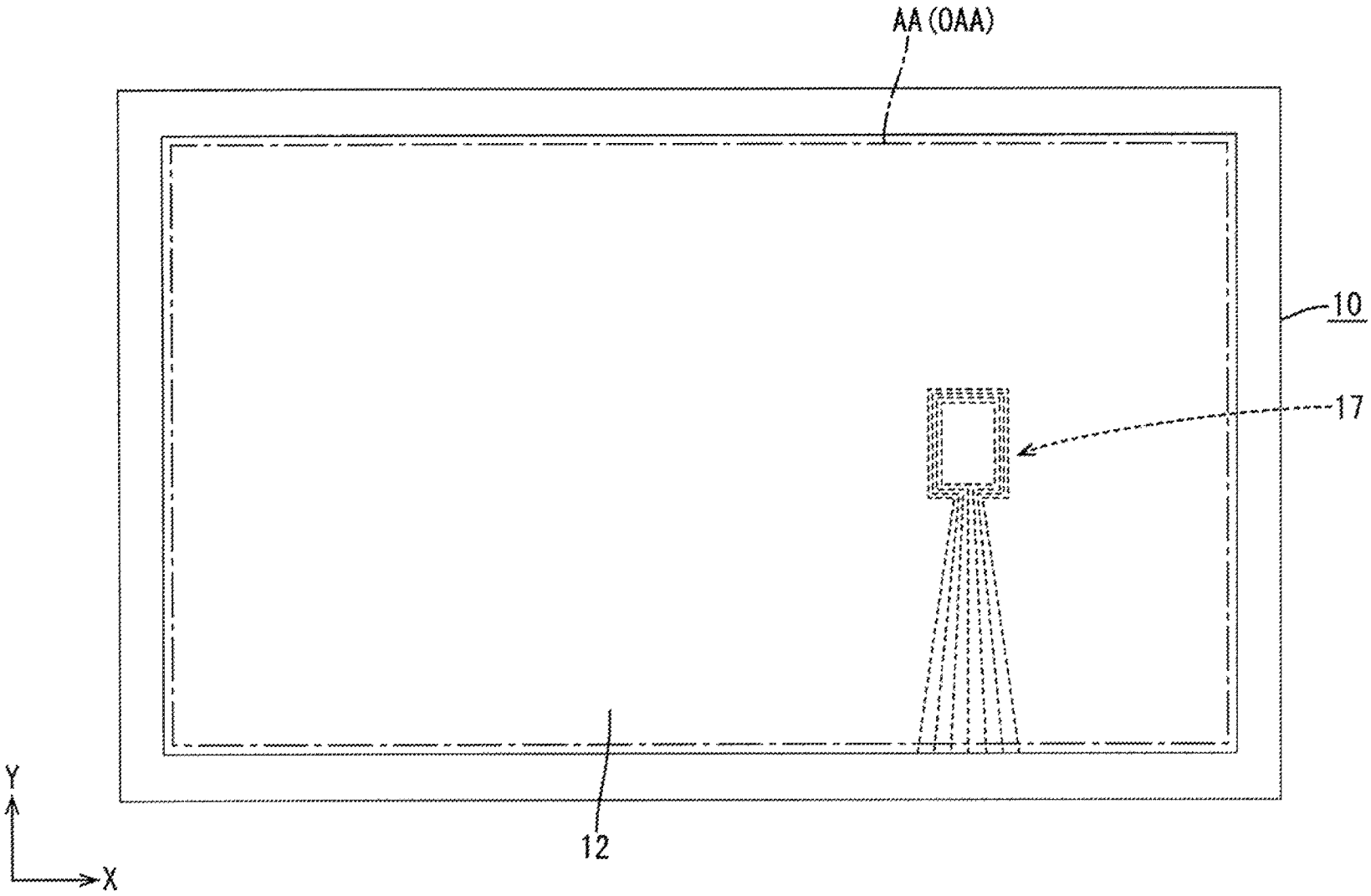
FIG. 3 is a front view of the liquid crystal display device.

The liquid crystal panel 11, as illustrated in FIG. 2 and FIG. 3, has a laterally long quadrilateral (rectangular) shape as viewed in plan. The liquid crystal panel 11 made of a pair of highly light-transmissive glass substrates affixed to each other via a predetermined gap, with liquid crystal encapsulated between the substrates. The liquid crystal panel 11 is assembled in the liquid crystal display device 10 in a posture such that the long-side direction is aligned with the X-axis direction, the short-side direction is aligned with the Y-axis direction, and the thickness direction is aligned with the Z-axis direction. Of the pair of substrates, one substrate (array substrate) is provided with, e.g., a switching element (such as a TFT) connected to a source line and a gate line which are perpendicular to each other; pixel electrodes connected to the switching element; and an alignment film. The other substrate (CF substrate) is provided with, e.g., a color filter in which colored portions of R (red), G (green), B (blue) and the like are disposed in a predetermined arrangement; a counter electrode; and an alignment film. The liquid crystal panel 11 has its display surface divided into a display region (active area) AA on the inner side of the screen on which an image can be displayed, and a non-display region (non-active area) NAA at the outer periphery side of the screen which has a frame shape (picture-frame shape) circumscribing the display region AA. The display region AA has a laterally long quadrilateral shape, whereas the non-display region NAA has a laterally long frame shape. In FIG. 3, the region enclosed by a dashed-and-dotted line indicates the display region AA, on the outside of which the non-display region NAA lies. On the outer-surface sides of the pair of substrates, a pair of upper and lower polarization plates is respectively affixed. The liquid crystal panel 11 thus configured is supplied with light from the back-light device 13. The back-light device 13 is provided with, at least, a light source (such as a cold cathode tube, an LED, or an organic EL), and an optical member which has the optical function of, e.g., converting the light from the light source into a planar shape.

The transparent antenna substrate 12 and the transparent antenna 17 disposed thereon will now be described. The transparent antenna substrate 12 is made of a synthetic resin material, such as polyethylene terephthalate (PET), and substantially transparent with excellent optical transparency. The transparent antenna substrate 12, as illustrated in FIG. 2 and FIG. 3, has a sheet-shape with a dimension and outline, as viewed in plan, which are substantially the same as those of the liquid crystal panel 11. In FIG. 3, the transparent antenna 17 is indicated by broken lines. Accordingly, the transparent antenna substrate 12, as illustrated in FIG. 4, has a display overlapping region OAA that overlapsthe display region AA of the liquid crystal panel 11 as viewed in plan, and a non-display overlapping region NOAA that overlaps the non-display region NAA of the liquid crystal panel 11 as viewed in plan. The transparent antenna 17 is formed by forming and patterning a meshed metal film in mesh (meshed) form on a sheet surface of the transparent antenna substrate 12 on the inner side, i.e., on the liquid crystal panel 11 side. The meshed metal film is formed such that a number of fine meshes (mesh) are regularly two-dimensionally arranged on a light-blocking metal film so as to ensure a constant optical transmittance of the transparent antenna substrate 12 by the light passing through the mesh. The meshes patterned on the meshed metal film each have a diamond-shaped planar shape with a diagonal pitch on the order of 0.5 mm, for example. The meshed metal film is formed in substantially the entire area of the display overlapping region OAA on the sheet surface of the transparent antenna substrate 12. In this way, difference in optical transmittance (transparency) in the transparent antenna substrate 12 is reduced between the antenna-formed region in which the transparent antenna 17 is formed and the antenna non-formed region in which the transparent antenna 17 is not formed. That is, the display overlapping region OAA is a meshed metal film-formed region. Meanwhile, on the sheet surface on the inner side of the transparent antenna substrate 12 in the non-display overlapping region NOAA, a light-blocking film (not illustrated) is formed in substantially the entire area, and additionally, a non-meshed metal film (solid metal film) constituting antenna connecting wire portions 20 is formed, as will be described later. The meshed metal film and the non-meshed metal film may be made of a metal material having excellent electrical conductivity, such as copper.

In the transparent antenna 17, as illustrated in FIG. 4, the meshed metal film formed in the transparent antenna substrate 12 has slits SL, whereby the planar shape and wiring pattern of the transparent antenna 17 are defined. In FIG. 4, the slits SL are shown outlined in white. The transparent antenna 17 is provided with a ring-shaped antenna body portion 18 which generates a magnetic field on the inner side; and a lead-out wire portions 19 led out from the antenna body portion 18. The transparent antenna 17 is configured such that the antenna body portion 18 is disposed at a position that is spaced apart from a boundary position between the display overlapping region OAA and the non-display overlapping region NOAA of the transparent antenna substrate 12 toward the center of the screen of the liquid crystal panel 11 by a predetermined distance with respect to the Y-axis direction, with the lead-out wire portions 19 disposed between the boundary position and the antenna body portion 18. Specifically, in the transparent antenna 17, the antenna body portion 18 is disposed at substantially the center position of the liquid crystal panel 11 with respect to the Y-axis direction. Accordingly, it may be said that the greater the screen size of the liquid crystal panel 11, the longer the creepage distance of the lead-out wire portions 19 tends to become. When the transparent antenna 17 is thus located near the center of the screen of the liquid crystal panel 11, enhanced convenience of use can be obtained. For example, the user can bring his or her external device with which the transparent antenna 17 is to communicate closer to the transparent antenna 17 intuitively. The transparent antenna 17 has its entire area disposed in the display overlapping region OAA of the transparent antenna substrate 12. On the other hand, in the non-display overlapping region NOAA of the transparent antenna substrate 12, the antenna connecting wire portions 20 connected to the lead-out wire portions 19 of the transparent antenna 17 are disposed. The antenna connecting wire portions 20 are connected to an antenna electric power supply circuit that is not illustrated, so that the transparent antenna 17 can be supplied with electric power, i.e., a current for generating a magnetic field.

The antenna body portion 18, as illustrated in FIG. 4, has a closed ring shape to surround a magnetic field generation region MA on the inner side in which the magnetic field develops. The antenna body portion 18 has a longitudinal quadrilateral shape in a plan view. The antenna body portion 18 has an internal dimension with respect to the long-side direction of approximately 85.6 mm, for example, and an internal dimension with respect to the short-side direction of approximately 54 mm, for example. The device-side antenna DA on the external device has substantially the same outline dimension as the antenna body portion 18. Accordingly, when the device-side antenna DA is disposed in a proper planar position (hereafter referred to as a "normal position") with respect to the antenna body portion 18 and brought close thereto, the device-side antenna DA is disposed to over the entire area of the magnetic field generation region MA. In this way, the magnetic field generated in the magnetic field generation region MA can be substantially entirely captured by the device-side antenna DA. The antenna body portion 18 is disposed with the long-side direction and the short-side direction respectively aligned with the Y-axis direction and the X-axis direction. The antenna body portion 18 has a pair of long-side portions 18L extending along the Y-axis direction, and a pair of short-side portions 18S extending along the X-axis direction. A current flowed through the four side portions 18L, 18S of the antenna body portion 18 can cause an electromagnetic induction whereby a magnetic field is generated in the magnetic field generation region MA. Accordingly, compared to if the antenna body portion is made of three side portions, higher induced electromotive force can be obtained. The antenna body portion 18 includes a plurality (three in FIG. 4) of antenna element wires 21 formed in a quadrilateral ring-shape and arranged radially, with intervals corresponding to the slits SL provided between the element wires. The plurality of antenna element wires 21 have a planar shape similar to the antenna body portion 18. The outline of the planar shape tends to become smaller and the creepage distance (the length dimension of each side portion) tends to become shorter with decreasing distance to the magnetic field generation region MA. Conversely, the outline becomes larger and the creepage distance becomes longer with increasing distance from the magnetic field generation region MA. That is, an antenna element wire 21 close to the magnetic field generation region MA has a slightly smaller outline than the antenna element wire 21 adjacent thereto on the side farther from the magnetic field generation region MA, and is entirely circumscribed by the adjacent antenna element wire 21. The antenna element wires 21 have their both ends disposed at the short-side portions 18S on the lower side in FIG. 4 (on the lead-out wire portions 19 side), and are respectively connected to different lead-out wire portions 19. The antenna element wire 21 at the innermost periphery that has the shortest creepage distance has a gap between both ends thereof which corresponds to only one slit SL. The middle antenna element wire 21 has, in addition to a gap corresponding to three slits SL between both ends thereof, two lead-out wire portions 19 (the lead-out wire portions 19 connected to the antenna element wires 21 at the innermost periphery) interposed therebetween. The antenna element wire 21 at the outermost periphery that has the longest creepage distance has, in addition to a gap corresponding to five slits SL between both ends thereof, four lead-out wire portions 19 (the lead-out wire portions 19 respectively connected to the antenna element wire 21 at the innermost periphery and the middle antenna element wire 21) interposed therebetween. The antenna element wires 21 have shapes which are symmetric with respect to a center line along the Y-axis direction.

The lead-out wire portions 19, as illustrated in FIG. 4, are routed extending from the boundary position between the display overlapping region OAA and the non-display overlapping region NOAA of the transparent antenna substrate 12 to the antenna body portion 18. A plurality (six in FIG. 4) of lead-out wire portions 19 are arranged side by side along a direction (the X-axis direction) intersecting the extending direction, the number of the lead-out wire portions 19 provided being twice the number of the antenna element wires 21 provided. The lead-out wire portions 19 have ends on the antenna body portion 18 side (from which the wire portions are lead out) connected to the ends of the antenna element wires 21, and ends on the opposite side (to which the wire portions lead; the boundary position side) connected to the antenna connecting wire portions 20. The lead-out wire portions 19 have greater wire resistance with increasing creepage distance thereof. Accordingly, the larger the screen size of the liquid crystal panel 11, the greater the wire resistance associated with the lead-out wire portions 19 tends to become.

The antenna connecting wire portions 20, as illustrated in FIG. 4, is made of a non-meshed metal film formed in the non-display overlapping region NOAA of the transparent antenna substrate 12. Accordingly, the antenna connecting wire portions 20, compared with the antenna body portion 18 and the lead-out wire portions 19 which constitute the transparent antenna 17 made of meshed metal film, has a relatively low wire resistance per unit length or unit area. The antenna connecting wire portions 20 include a plurality (two in FIG. 4) of short-circuit wire portions 22 each short-circuiting two lead-out wire portions 19. The number of the short-circuit wire portions 22 provided is the value obtained by subtracting two from the number of the lead-out wire portions 19 provided. The two lead-out wire portions 19 that are short-circuited by the short-circuit wire portions 22 are connected to mutually different antenna element wires 21. Specifically, the lead-out wire portion 19 connected to one end (on the left side in FIG. 4) of the antenna element wire 21 at the outermost periphery is short-circuited with respect to the lead-out wire portion 19 connected to one end (on the right side in FIG. 4) of the middle antenna element wire 21 by a short-circuit wire portion 22. The lead-out wire portion 19 connected to the other end (on the left side in FIG. 4) of the middle antenna element wire 21 is connected to the lead-out wire portion 19 connected to one end (on the right side in FIG. 4) of the antenna element wire 21 at the innermost periphery by a short-circuit wire portion 22. The antenna connecting wire portions 20 include an input wire portion (not illustrated) connected to the lead-out wire portion 19 connected to the other end (on the right side of FIG. 4) of the antenna element wire 21 at the outermost periphery; and an output wire portion (not illustrated) connected to the lead-out wire portion 19 connected to one end (on the left side of FIG. 4) of the antenna element wire 21 at the innermost periphery. Accordingly, a current flowed from the input wire portion flows via the lead-out wire portion 19 to the antenna element wire 21 at the outermost periphery in the anticlockwise direction in FIG. 4, enters the middle antenna element wire 21 via the lead-out wire portion 19 and the short-circuit wire portion 22, and further flows to the antenna element wire 21 at the outermost periphery via the lead-out wire portion 19 and the short-circuit wire portion 22 in the anticlockwise direction in FIG. 4, and eventually to the output wire portion. In this way, in the antenna body portion 18, when the current flows in the anticlockwise direction in FIG. 4, a magnetic field directed toward the front of the sheet of FIG. 4 is generated in the magnetic field generation region MA of the antenna body portion 18.

As described above, when the antenna body portion 18 of the transparent antenna 17 is disposed in the inner side of the screen of the liquid crystal panel 11, the creepage distance of the lead-out wire portions 19 tends become long, the tendency becoming more pronounced as the screen size is increased. For example, a configuration is assumed in which the transparent antenna is disposed at the end of the screen of the liquid crystal panel 11, where the antenna body portion has an internal dimension in the long-side direction of 85.6 mm and an internal dimension in the short-side direction of 54 mm, with almost no lead-out wire portion provided. In this case, the Q-value of the transparent antenna will have a sufficiently high value of approximately 19.765.

In contrast, if the lead-out wire portion has a length of 20 cm, the Q-value of the transparent antenna will be less than one half or approximately 8.757, which is lower than the Q-value of 10 indicating a sufficient induced electromotive force. The Q-value, indicating the antenna performance of the transparent antenna, is expressed by an expression "$2\pi fL/R$". Of the expression, "L" is the inductance (induced electromotive force); "R" is the wire resistance; and "f" is the resonant frequency. That is, the Q-value tends to be proportional to inductance and inversely proportional to wire resistance.

Accordingly, the transparent antenna 17 according to the present embodiment, as illustrated in FIG. 4, has a configuration in which the lead-out wire portions 19 include large-width portions 23 having greater line widths than the antenna body portion 18. By adopting the configuration in which the lead-out wire portions 19 include the large-width portions 23, the wire resistance of the transparent antenna 17 can be decreased. As a result, the Q-value of the transparent antenna 17 is increased, whereby a further increase in antenna performance (such as reception sensitivity) can be achieved.

The large-width portions 23, as illustrated in FIG. 4, have line widths that become gradually wider with increasing distance from the antenna body portion 18 toward the boundary position between the display overlapping region OAA and the non-display overlapping region NOAA (antenna connecting wire portions 20) of the transparent antenna substrate 12. In other words, the line widths of the large-width portions 23 become gradually narrower with decreasing distance to the antenna body portion 18 and increasing distance from the boundary position between the display overlapping region OAA and the non-display overlapping region NOAA of the transparent antenna substrate 12. Accordingly, the large-width portions 23 may be said to include "line width-varying large-width portions" of which the line widths are varying depending on the position with respect to the extending direction.

The large-width portions 23, as illustrated in FIG. 4, have the line widths thereof continuously and gradually increasing in proportion to the distance from the antenna body portion 18, and have outlines which are linearly inclined with respect to the directions along the respective side portions 18L, 18S of the antenna body portion 18 (the X-axis direction and the Y-axis direction). Accordingly, the large-width portions 23 may be said to include "inclined large-width portions" of which the outer edges extend while being inclined. The large-width portions 23 constitute the entire areas of the lead-out wire portions 19, with the part (the end on the antenna body portion 18 side) that is connected to the antenna element wires 21 of the antenna body portion 18 having the smallest line width and the part (the end on the opposite side from the antenna body portion 18 side) that is connected to the antenna connecting wire portions 20 having the greatest line width. The plurality of lead-out wire portions 19 have substantially the same minimum line widths and maximum line widths, with the rate of change in the line widths being also substantially the same. The maximum outer width of the plurality of lead-out wire portions 19 arranged side by side along the X-axis direction is greater than the maximum outer width of the antenna body portion 218.

Figure 5:
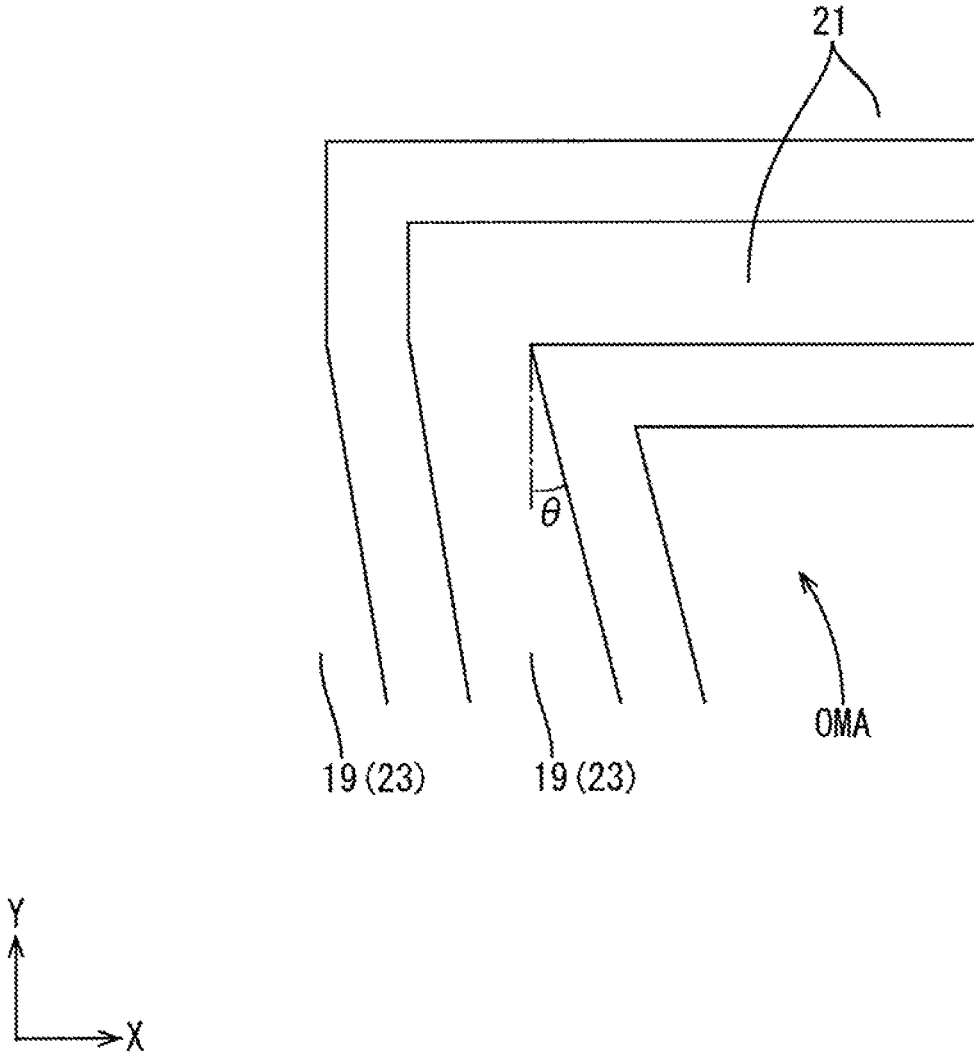
FIG. 5 is an enlarged view of the transparent antenna.
Figure 6:
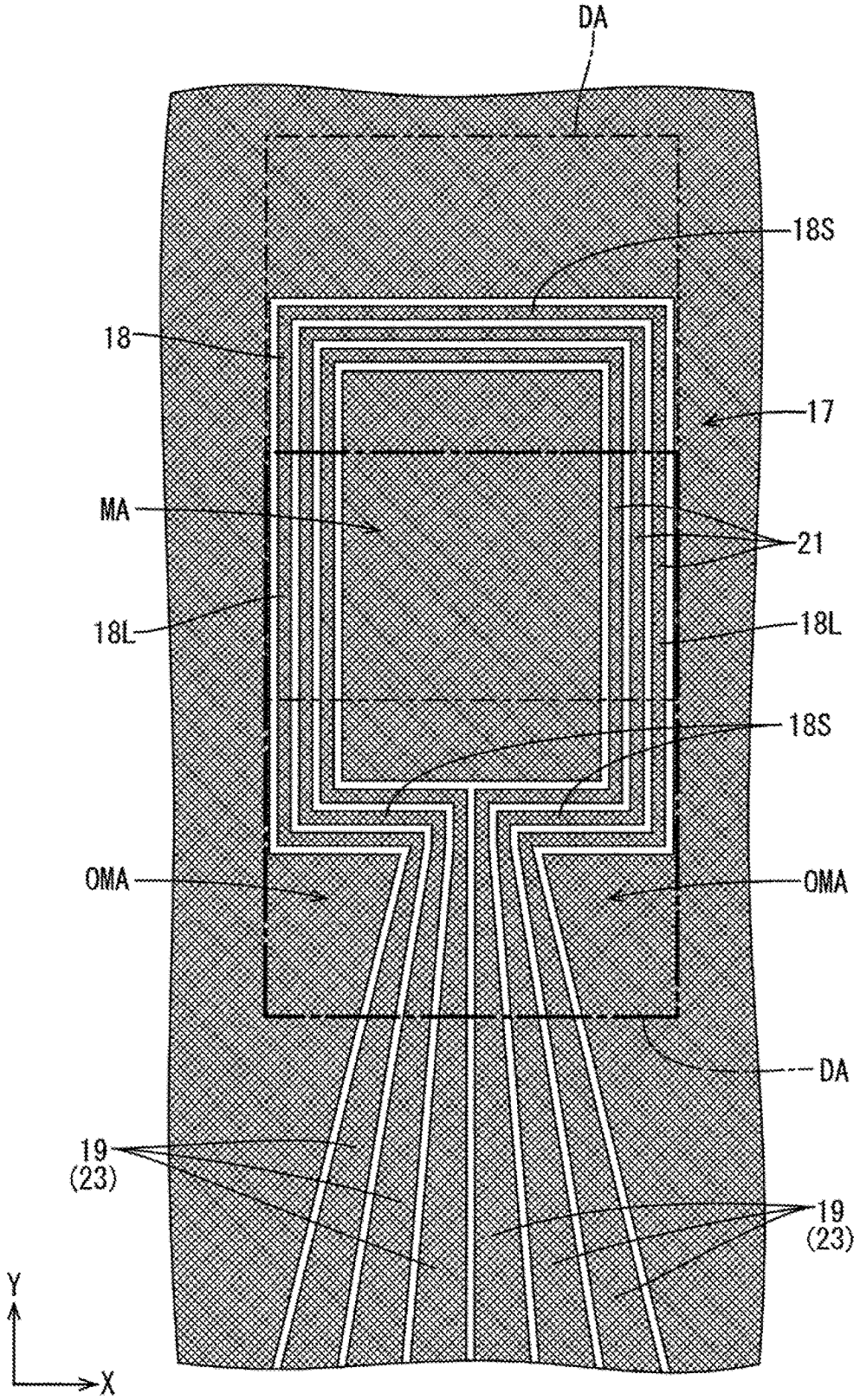
FIG. 6 is a plan view illustrating a state in which the planar arrangement of a device-side antenna is displaced with respect to the transparent antenna.

Of the plurality of lead-out wire portions 19, the large-width portions 23 of the two lead-out wire portions 19 disposed at the outermost position with respect to the X-axis direction, as illustrated in FIG. 4 and FIG. 5, are configured to have an inclination angle θ of not less than 14 degrees or, specifically, approximately 14 degrees to 15 degrees with respect to a direction perpendicular to the short-side portions 18S of the antenna body portion 18 with which the large-width portions 23 are connected, i.e., with respect to the Y-axis direction. In the configuration, of the plurality of lead-out wire portions 19, those on the outer side with respect to the X-axis direction have greater inclination angles θ, and those closer to the inner side with respect to the X-axis direction have smaller inclination angles θ. In FIG. 5, illustration of the mesh of the meshed metal film is omitted, and the antenna element wires 21 and the lead-out wire portions 19 are only shown in outlines.

The large-width portions 23 of the lead-out wire portions 19 and the short-side portions 18S of the antenna body portion 18 that are connected with the large-width portions 23 may constitute an additional coil. That is, when the transparent antenna 17 is energized, a current flows from the lead-out wire portions 19 to the short-side portions 18S connected therewith. Accordingly, the lead-out wire portions 19 and the short-side portions 18S constitute the additional coil generating an inverse magnetic field in the regions interposed therebetween (hereafter referred to as "inverse magnetic field generating regions OMA") in the opposite direction from the magnetic field (hereafter referred to as a "normal magnetic field") generated in the magnetic field generation region MA on the inner side of the antenna body portion 18. Accordingly, if, for example, the device-side antenna DA of the external device is brought close to the transparent antenna 17 in a planar arrangement displaced from the normal position with respect to the antenna body portion 18, specifically the planar arrangement straddling the magnetic field generation region MA and the inverse magnetic field generating regions OMA (see the thick dashed-and-dotted line in FIG. 6), the device-side antenna DA will be able to only partly capture the normal magnetic field generated in the magnetic field generation region MA. Not only that, the normal magnetic field may be weakened by the inverse magnetic field generated in the inverse magnetic field generating regions OMA. As a result, the induced electromotive force may be greatly reduced, and the antenna performance may greatly deteriorate.

In this respect, the large-width portions 23, as illustrated in FIG. 4, are inclined with respect to the direction along the side portions 18L, 18S of the antenna body portion 18. Accordingly, compared to if the large-width portions are to be configured to extend along the direction perpendicular to the short-side portions 18S with which they are connected, the inverse magnetic field generating regions OMA in which the inverse magnetic field is generated is narrower, so that the ratio of the strength of the inverse magnetic field with respect to the strength of the normal magnetic field becomes relatively low. This makes it possible to decrease the deterioration in antenna performance due to the inverse magnetic field even if the device-side antenna DA has the planar arrangement displaced from the normal position with respect to the antenna body portion 18. In addition, the large-width portions 23 have the angle of not less than 14 degrees with respect to the direction perpendicular to the side portions of the antenna body portion 18 that is connected with the large-width portions. Accordingly, the regions in which the inverse magnetic field is generated are sufficiently narrow so that the ratio of the strength of the inverse magnetic field with respect to the strength of the normal magnetic field is made sufficiently low. Thus, the deterioration in antenna performance due to the inverse magnetic field can be sufficiently reduced.

Figure 7:
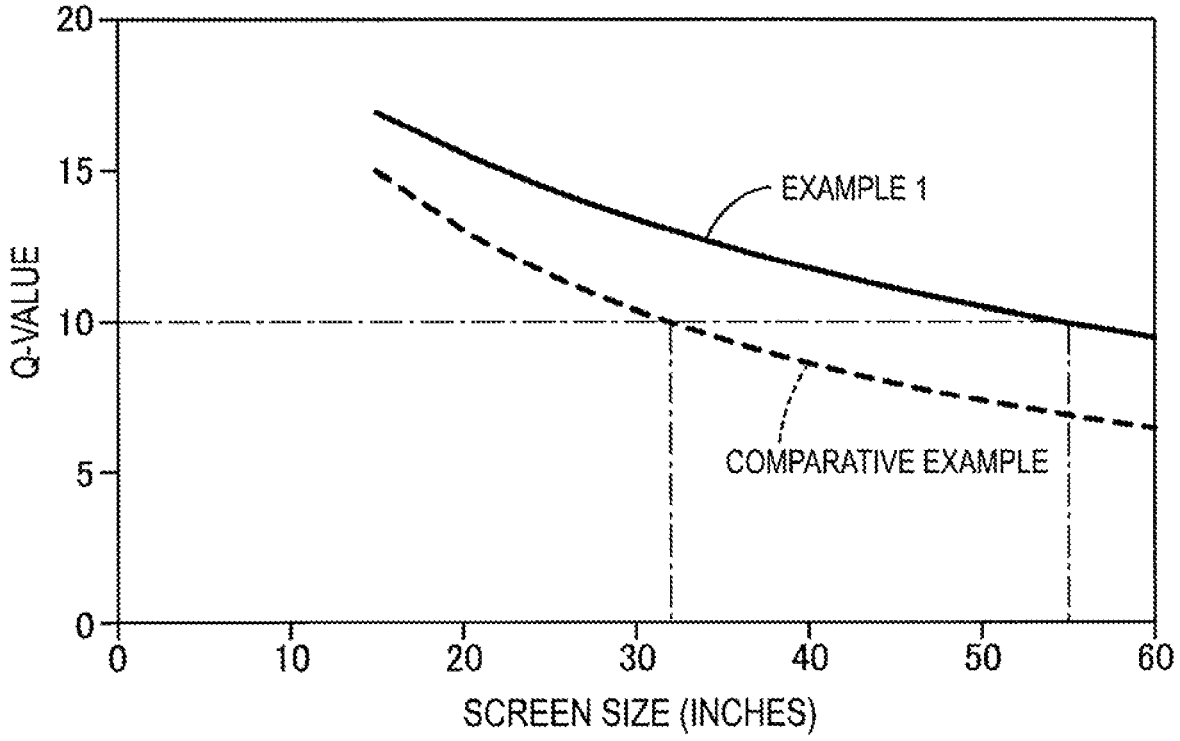
FIG. 7 is a graph illustrating relationships between the Q-values of the transparent antennas according to a comparative example and Example 1 and the screen size of the liquid crystal panel in Comparative Experiment 1.

In order to gain knowledge about how the Q-value of the transparent antenna 17 of the above configuration varies in accordance with the screen size of the liquid crystal panel 11, Comparative Experiment 1 was conducted as described below. In Comparative Experiment 1, a comparative example included a transparent antenna with a configuration in which the lead-out wire portions extended straight along the direction perpendicular to the direction in which the short-side portions of the antenna body portion extended, the lead-out wire portions having a constant line width. Example 1 included the transparent antenna 17 with the large-width portions 23 as described in the foregoing paragraphs. The transparent antennas according to the comparative example and Example 1 were used in the liquid crystal display device 10 provided with the liquid crystal panel 11 of various screen sizes, and the Q-value was measured. The results are shown in FIG. 7. In FIG. 7, the horizontal axis shows the screen size of the liquid crystal panel 11 (in units of inches), and the vertical axis shows the Q-value of the transparent antenna (no unit). In FIG. 7, the solid line plot shows the experimental results for Example 1, and the broken line plot shows the experimental results for the comparative example. The transparent antennas according to the comparative example and Example 1 were both configured such that the respective antenna body portions were disposed at the center position of the liquid crystal panel 11 with respect to the Y-axis direction, in each screen size of the liquid crystal panel 11. Accordingly, the greater the screen size, the longer the creepage distance of the lead-out wire portions became.

The experimental results for Comparative Experiment 1 will be described. According to FIG. 7, it can be seen that for both the comparative example and Example 1, the Q-value of the transparent antenna tends to decrease as the screen size of the liquid crystal panel 11 becomes larger. In the comparative example, the Q-value of the transparent antenna has a greater decrease rate than in Example 1. Specifically, in the comparative example, as the screen size of the liquid crystal panel 11 exceeds 32 inches, the Q-value of the transparent antenna drops below 10, which is an indicator of the ability to obtain sufficient induced electromotive force. This shows that application to the liquid crystal display device 10 with the liquid crystal panel 11 of screen sizes greater than 32 inches is difficult. The reason that the Q-value of the transparent antenna according to the comparative example has such decrease rate is believed to be because the wire resistance increases as the creepage distance of the lead-out wire portions is increased by an increase in the screen size of the liquid crystal panel 11. On the other hand, in Example 1, the graph shows the Q-value constantly higher than in the comparative example, and the decrease rate of the Q-value of the transparent antenna is smaller than in the comparative example. Specifically, in Example 1, the Q-value is not less than 10 even when the screen size of the liquid crystal panel 11 is larger than 32 inches, and the Q-value stays not less than 10 until the screen size exceeds 55 inches. Accordingly, Example 1 can be applied to the liquid crystal display device 10 with the liquid crystal panel 11 of screen sizes up to 55 inches. The reason that the Q-value of the transparent antenna 17 according to Example 1 has the above-described decrease rate is believed to be because, although the creepage distance of the lead-out wire portions 19 increases as the screen size of the liquid crystal panel 11 becomes larger, the wire resistance is kept sufficiently low by the entire areas of the lead-out wire portions 19 being constituted by the large-width portions 23, which ensures a sufficiently large area for the lead-out wire portions 19. Accordingly, in Example 1, even when the screen size of the liquid crystal display device is increased, sufficient induced electromotive force and antenna performance can be obtained with the transparent antenna 17 disposed at around the center position of the screen.

Figure 8:
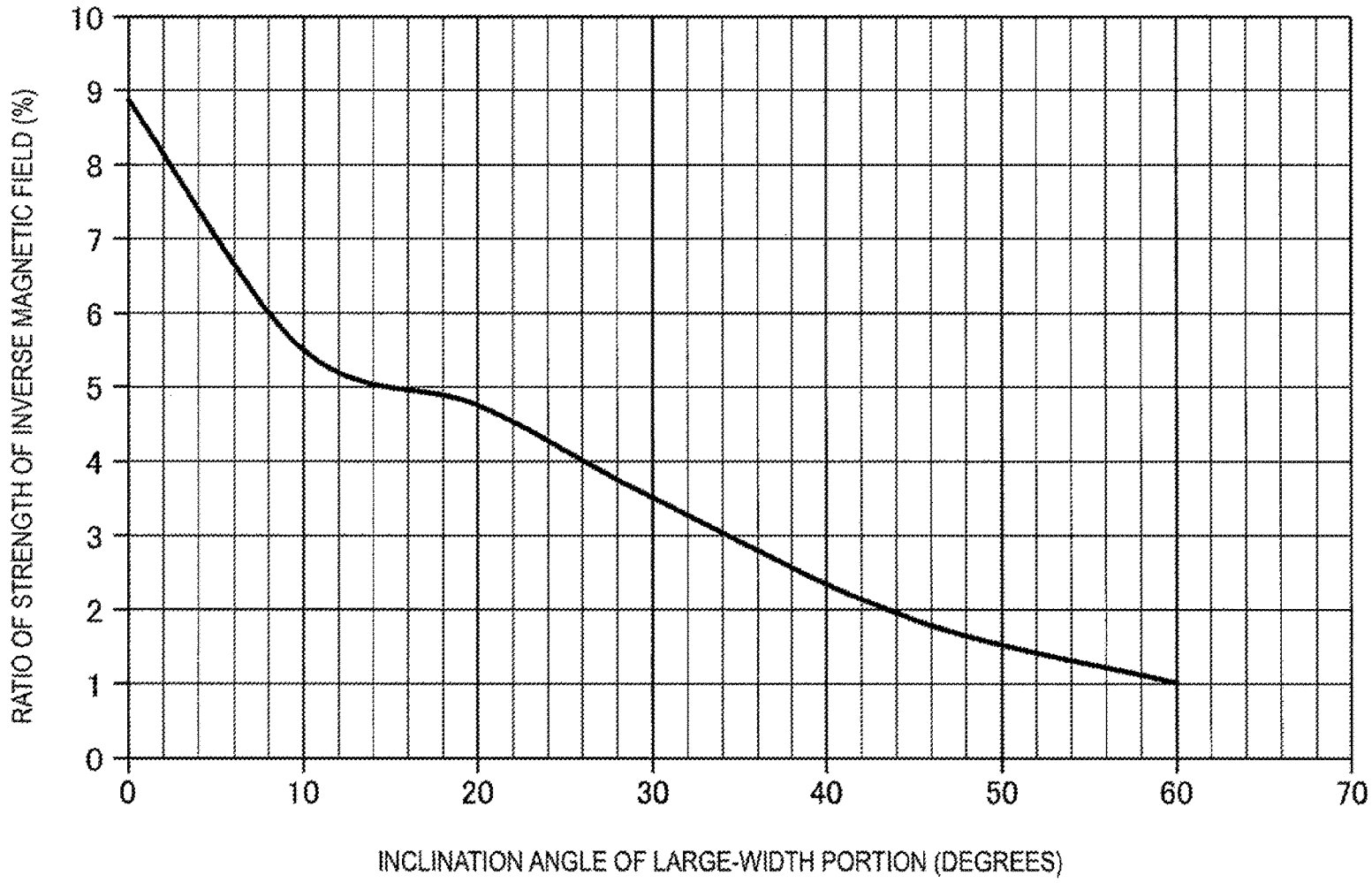
FIG. 8 is a graph illustrating a relationship between the inclination angle of a large-width portion and the ratio of the strength of an inverse magnetic field in Comparative Experiment 2.

In order to gain knowledge about the relationship between the inclination angle θ of the large-width portions 23 and the ratio of the strength of the inverse magnetic field due to the additional coil, Comparative Experiment 2 was conducted as described below. In Comparative Experiment 2, in the transparent antenna 17 including the large-width portions 23 according to Example 1 of Comparative Experiment 1, the inclination angle θ of the large-width portions 23 constituting the lead-out wire portions 19 at the outermost position with respect to the Y-axis direction was varied in a range of from 0 degree to 60 degrees, and the ratio of the strength of the inverse magnetic field due to the additional coil to the strength of the normal magnetic field was measured. The results are shown in FIG. 8. In FIG. 8, the horizontal axis shows the inclination angle θ of the large-width portions 23 (in units of degrees) constituting the lead-out wire portions 19 at the outermost position, and the vertical axis shows the ratio of the strength of the inverse magnetic field (in units of %).

The experimental results for Comparative Experiment 2 will be described. According to FIG. 8, it is seen that as the inclination angle θ of the large-width portions 23 constituting the lead-out wire portions 19 at the outermost position increases, the ratio of the strength of the inverse magnetic field due to the additional coil tends to decrease. It is also seen that, when the inclination angle θ of the large-width portions 23 constituting the lead-out wire portions 19 at the outermost position is less than 14 degrees, the ratio of the strength of the inverse magnetic field exceeds 5%, whereas when the inclination angle θ of the large-width portions 23 is 14 degrees and above, the ratio of the strength of the inverse magnetic field tends to be 5% or lower.

Figure 9:
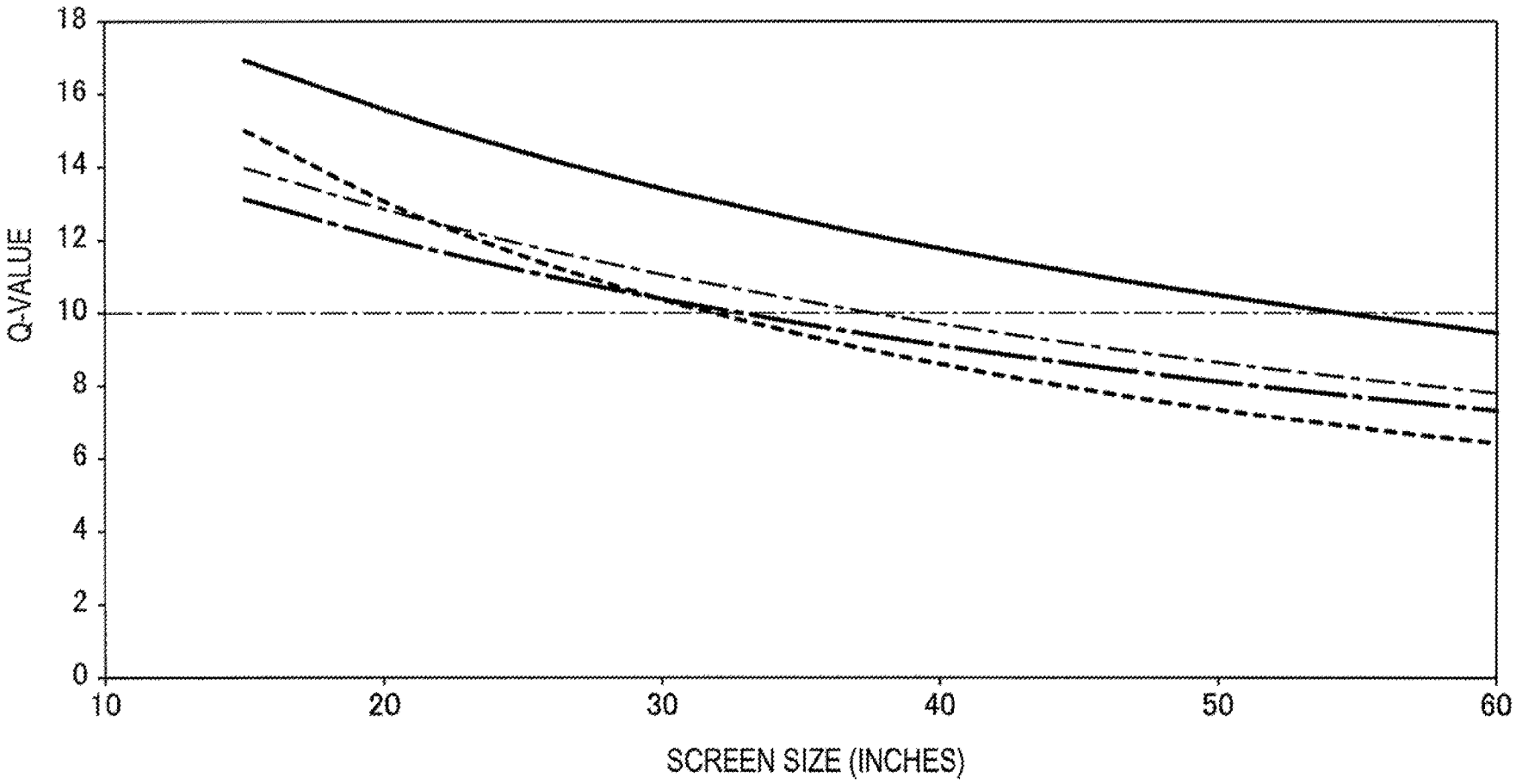
FIG. 9 is a graph illustrating relationships, in Comparative Experiment 3, between the Q-value of the transparent antenna according to Example 1 and the screen size of the liquid crystal panel when the device-side antenna was disposed in three different planar arrangements.

In order to gain knowledge about the influence of the inverse magnetic field when the planar position of the device-side antenna DA of the external device with respect to the transparent antenna 17 is displaced from the normal position, Comparative Experiment 3 was conducted as described below. In Comparative Experiment 3, the Q-value of the transparent antenna 17 including the large-width portions 23 according to Example 1 of Comparative Experiment 1 was measured while the screen size of the liquid crystal panel 11 was varied as in Comparative Experiment 1, with respect to: the case where the device-side antenna DA was in the normal position; the case where the device-side antenna DA was in a planar arrangement (see the thin dashed-and-dotted line in FIG. 6) displaced from the normal position by approximately 15 mm (a length of approximately 17.5% of the long-side dimension of the antenna body portion 18) toward the opposite side from the lead-out wire portions 19 with respect to the Y-axis direction; and the case where the device-side antenna DA was in a planar arrangement (see the thick dashed-and-dotted line in FIG. 6) displaced from the normal position by approximately 15 mm (a length of approximately 17.5% of the long-side dimension of the antenna body portion 18) toward the lead-out wire portions 19 with respect to the Y-axis direction. The results are shown in FIG. 9. In FIG. 9, the horizontal axis shows the screen size of the liquid crystal panel 11 (in units of inches), and the vertical axis shows the Q-value of the transparent antenna 17 (no unit). In FIG. 9, the solid line plot shows the experimental results for the case of the normal position; the plot of the thin dashed-and-dotted line shows the experimental results for the case of displacement toward the opposite side from the lead-out wire portions 19; and the plot of the thick dashed-and-dotted line shows the experimental results for the case of displacement toward the side of the lead-out wire portions 19. FIG. 9 also shows, for reference purpose, the experimental results for the comparative example of Comparative Experiment 1 by the broken line graph.

The experimental results for Comparative Experiment 3 will be described. According to FIG. 9, the Q-value is the highest in the case where the device-side antenna DA was in the normal position in Example 1. The next-highest Q-value is in the case where the device-side antenna DA was displaced from the normal position toward the opposite side from the lead-out wire portions 19 with respect to the Y-axis direction in Example 1. The Q-value was the lowest in the case where the device-side antenna DA was displaced from the normal position toward the lead-out wire portions 19 with respect to the Y-axis direction in Example 1. The reasons for such results will be described. First, in the case where, in Example 1, the device-side antenna DA is displaced from the normal position toward the opposite side from the lead-out wire portions 19 with respect to the Y-axis direction, as indicated by the thin dashed-and-dotted line in FIG. 6, the device-side antenna DA can only partly capture the normal magnetic field generated in the magnetic field generation region MA. However, in this case, the device-side antenna DA does not capture the inverse magnetic field because of the absence of superposing with the inverse magnetic field generating regions OMA. That is, when, in Example 1, the device-side antenna DA is displaced from the normal position toward the opposite side from the lead-out wire portions 19 with respect to the Y-axis direction, the Q-value is decreased by the amount of the normal magnetic field that is generated in a part of the magnetic field generation region MA with which the device-side antenna DA is not overlapped, compared to the case of the normal position. On the other hand, when, in Example 1, the device-side antenna DA is displaced from the normal position toward the lead-out wire portions 19 with respect to the Y-axis direction, as indicated by the thick dashed-and-dotted line in FIG. 6, the device-side antenna DA can only partly capture the normal magnetic field generated in the magnetic field generation region MA; in addition, the device-side antenna DA captures the inverse magnetic field due to the superposition with the inverse magnetic field generating regions OMA. In other words, when, in Example 1, the device-side antenna DA is displaced from the normal position toward the lead-out wire portions 19 with respect to the Y-axis direction, in addition to the decrease in the Q-value by the amount corresponding to the normal magnetic field generated in the part of the magnetic field generation region MA with which the device-side antenna DA is not overlapped, the Q-value is also decreased by the amount by which the normal magnetic field is cancelled by the inverse magnetic field.

In the case where, in Example 1, the device-side antenna DA is in the normal position, the Q-value is not less than 10 until the screen size of the liquid crystal panel 11 exceeds 55 inches, as illustrated in FIG. 9. On the other hand, in the case where, in Example 1, the device-side antenna DA is displaced from the normal position toward the opposite side from the lead-out wire portions 19 with respect to the Y-axis direction, the Q-value drops below 10 when the screen size of the liquid crystal panel 11 exceeds 38 inches. Further, in the case where, in Example 1, the device-side antenna DA is displaced from the normal position toward the lead-out wire portions 19 with respect to the Y-axis direction, the Q-value drops below 10 when the screen size of the liquid crystal panel 11 exceeds 33 inches. That is, it can be said that when the device-side antenna DA is displaced from the normal position toward the lead-out wire portions 19 with respect to the Y-axis direction in Example 1, the Q-value slightly exceeds the experimental results for the comparative example.

According to the experimental results for Comparative Experiment 2 (see FIG. 8), there is the tendency that the smaller the inclination angle θ of the large-width portions 23 constituting the lead-out wire portions 19 at the outermost position, the greater the ratio of the strength of the inverse magnetic field becomes, and, conversely, the greater the inclination angle θ, the smaller the ratio of the strength of the inverse magnetic field becomes. Accordingly, the graph for the case where, in Example 1 according to the experimental results for Comparative Experiment 3, the device-side antenna DA is displaced from the normal position toward the lead-out wire portions 19 with respect to the Y-axis direction (where the device-side antenna DA is disposed so as to capture the inverse magnetic field), will be shifted in a direction of decreasing Q-values as the inclination angle θ of the large-width portions 23 constituting the lead-out wire portions 19 at the outermost position is decreased, or, conversely, in a direction of increasing Q-values as the inclination angle θ is increased. In the transparent antenna 17 according to Example 1, the inclination angle θ of the large-width portions 23 constituting the lead-out wire portions 19 at the outermost position is in a range of approximately 14 degrees to 15 degrees, and the ratio of the strength of the inverse magnetic field is on the order of 5% (see FIG. 8). Accordingly, if the inclination angle θ of the large-width portions 23 becomes lower than 14 degrees and also the ratio of the strength of the inverse magnetic field exceeds 5%, the Q-value will become lower than in the comparative example. As a result, it may become impossible to ensure the Q-value of not less than 10 even when the screen size of the liquid crystal panel 11 is smaller than 32 inches. From the above analysis, it is believed that by setting the inclination angle θ of the large-width portions 23 to not less than 14 degrees, the ratio of the strength of the inverse magnetic field can be made not more than 5%, making it possible to sufficiently reduce a decrease in the Q-value when the device-side antenna DA is disposed so as to capture the inverse magnetic field.

As described above, according to the present embodiment, the transparent antenna 17 is provided with the antenna body portion 18 which has a ring-shape and generates a magnetic field on the inner side thereof, and the lead-out wire portions 19 led out of the antenna body portion 18, the lead-out wire portions 19 at least partly including the large-width portions 23 having greater line widths than the line width of the antenna body portion 18.

In this way, when the lead-out wire portions 19 are energized and a current flows through the ring-shaped antenna body portion 18, a magnetic field is generated by electromagnetic induction on the inner side of the antenna body portion 18. Because the lead-out wire portions 19 at least partly include the large-width portions 23 having greater line widths than the line width of the antenna body portion 18, the wire resistance of the transparent antenna 17 can be decreased. As a result, the Q-value of the transparent antenna 17 is increased, whereby an increase in antenna performance can be achieved.

The antenna body portion 18 has a ring-shape that is closed so as to circumscribe the magnetic field generation region MA on the inner side in which the magnetic field is generated. In this way, compared to if the antenna body portion has an open ring-shape, higher induced electromotive force can be obtained. Accordingly, higher antenna performance can be obtained.

The large-width portions 23 also include the line width-varying large-width portion of which the line width becomes gradually wider with increasing distance from the antenna body portion 18. In this way, the large-width portions 23 constituting the lead-out wire portions 19 led out of the antenna body portion 18 having the closed ring-shape include the line width-varying large-width portion of which the line width becomes gradually wider with increasing distance from the antenna body portion 18. Accordingly, compared to if the large-width portions has a constant line width, wire resistance can be preferably decreased while the high induced electromotive force of the antenna body portion 18 is maintained.

While the antenna body portion 18 includes the four side portions 18L, 18S forming a quadrilateral ring-shaped planar shape, the line width-varying large-width portion is connected with one short-side portion (side portion) 18S of the antenna body portion 18, and the line width-varying large-width portion includes the inclined large-width portion that is inclined with respect to the direction along the side portions 18L, 18S of the antenna body portion 18. The line width-varying large-width portion of the lead-out wire portions 19 and the short-side portion 18S of the antenna body portion 18 that is connected with the line width-varying large-width portion may constitute an additional coil. The magnetic field generated by the additional coil (referred to as an "inverse magnetic field") has an opposite direction from the magnetic field generated in the magnetic field generation region MA on the inner side of the antenna body portion 18, and may cause deterioration in antenna performance. In this respect, the line width-varying large-width portion includes the inclined large-width portion that is inclined with respect to the direction along the side portions 18L, 18S of the antenna body portion 18. Accordingly, compared to the configuration in which the lead-out wire portions 19 extend along the direction perpendicular to the short-side portions 18S with which the line width-varying large-width portion is connected, the region in which the inverse magnetic field is generated becomes narrower, and the ratio of the inverse magnetic field becomes relatively low. Accordingly, deterioration in antenna performance due to the inverse magnetic field can be reduced.

A plurality of lead-out wire portions 19 are arranged side by side. Of the plurality of lead-out wire portions 19, those disposed at the outermost position include the line width-varying large-width portion that is configured to have an angle of not less than 14 degrees with respect to the direction perpendicular to the short-side portion 18S of the antenna body portion 18 connected with the line width-varying large-width portion. If the line width-varying large-width portion of the lead-out wire portions 19 disposed at the outermost position has an angle of less than 14 degrees with respect to the direction perpendicular to the short-side portion 18S of the antenna body connected with the line width-varying large-width portion, the ratio of the inverse magnetic field would be too high, and antenna performance may deteriorate to an unacceptable level. In this respect, the line width-varying large-width portion of the lead-out wire portions 19 disposed at the outermost position has an angle of not less than 14 degrees with respect to the direction perpendicular to the short-side portion 18S of the antenna body that is connected with the line width-varying large-width portion. Accordingly, the region in which the inverse magnetic field is generated is made sufficiently narrow, and the ratio of the inverse magnetic field is made sufficiently low, whereby deterioration in antenna performance due to the inverse magnetic field can be sufficiently reduced.

The lead-out wire portions 19 are entirely configured of the large-width portions 23. In this way, compared to if some of the lead-out wire portions have the same line width as the line width of the antenna body portion 18, a greater area can be ensured for the lead-out wire portions 19. Accordingly, the wire resistance of the transparent antenna 17 can be decreased more, whereby a further increase in antenna performance can be achieved.

The antenna body portion 18 and the lead-out wire portions 19 are made of a meshed metal film, and have the planar shapes thereof defined by slits patterned in the metal film. In this way, the wire resistance can be decreased while ensuring optical transparency of the transparent antenna 17.

According to the present embodiment, the liquid crystal display device (transparent antenna-attached display device) 10 is provided with: the transparent antenna 17; the transparent antenna substrate 12 on which the transparent antenna 17 is disposed; and the liquid crystal panel (display panel) 11 stacked on the transparent antenna substrate 12, the liquid crystal panel 11 including the display region AA in which an image can be displayed and the non-display region NAA circumscribing the display region AA. The transparent antenna 17 is disposed to overlap the display region AA.

In this way, by utilizing the transparent antenna 17 disposed to overlap the display region AA of the liquid crystal panel 11, communication with an external device and the like can be performed, for example. Because an operation, such as bringing the external device closer to the transparent antenna 17 based on the image displayed in the display region AA, can be performed, enhanced convenience of use and the like can be obtained. Because the antenna performance of the transparent antenna 17 is sufficiently increased, communication with the external device and the like can be performed satisfactorily.

The transparent antenna substrate 12 is provided with the antenna connection wiring portions 20 which are disposed to overlap the non-display region NAA and connected to the lead-out wire portions 19. In this way, because the antenna connection wiring portions 20 disposed to overlap the non-display region NAA are connected to the lead-out wire portions 19, it becomes possible, for example, to configure the antenna connection wiring portions 20 from a light-blocking metal film (non-meshed metal film). In this way, the wire resistance of the transparent antenna 17 can be further decreased.

The transparent antenna 17 is configured such that the antenna body portion 18 includes antenna element wires 21, with the lead-out wire portions 19 being individually connected to the ends of the respective antenna element wires 21. The antenna connection wiring portions 20 include the short-circuit wire portions 22 short-circuiting two lead-out wire portions 19 connected to the ends of mutually different antenna element wires 21. In this way, by the short-circuit wire portions 22 short-circuiting the two lead-out wire portions 19 connected to the ends of mutually different antenna element wires 21, it becomes possible to flow a current through the antenna element wires 21 respectively connected to the short-circuited two lead-out wire portions 19. Accordingly, a magnetic field can be generated on the inner side of the antenna body portion 18.

Second Embodiment

Figure 11:
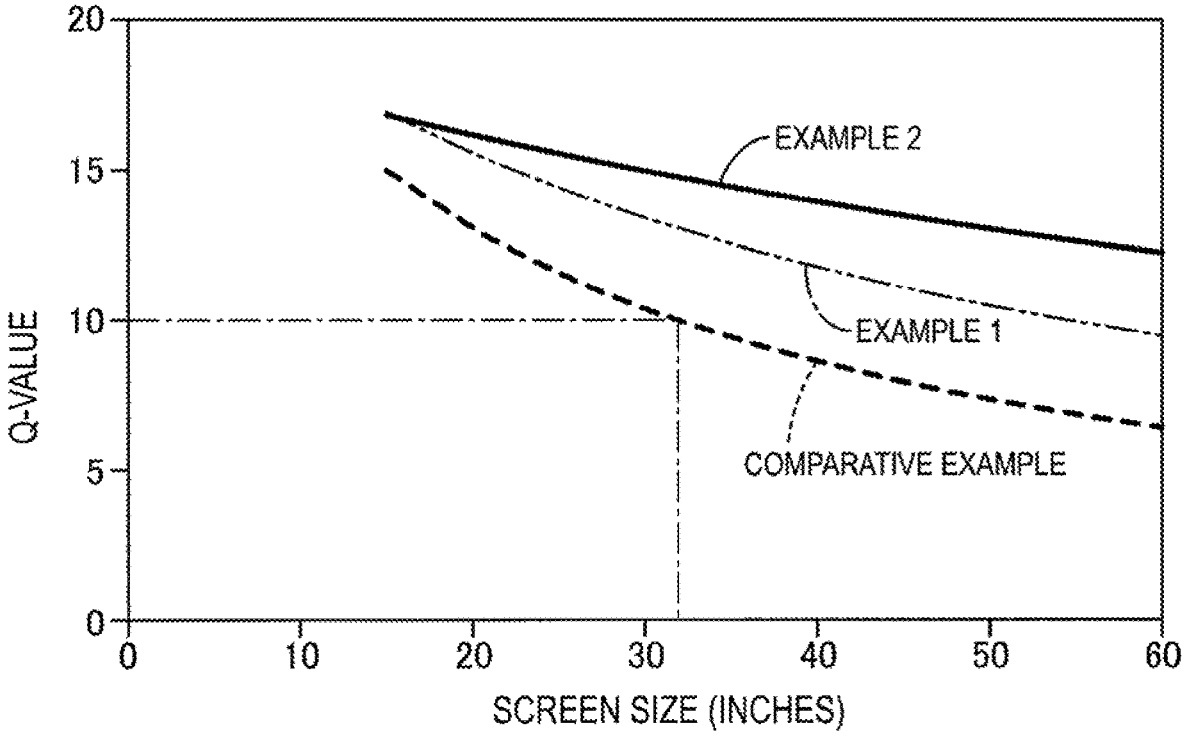
FIG. 11 is a graph illustrating relationships, in Comparative Experiment 4, between the Q-values of the transparent antennas according to a comparative example and Examples 1 and 2 and the screen size of the liquid crystal panel.
Figure 12:
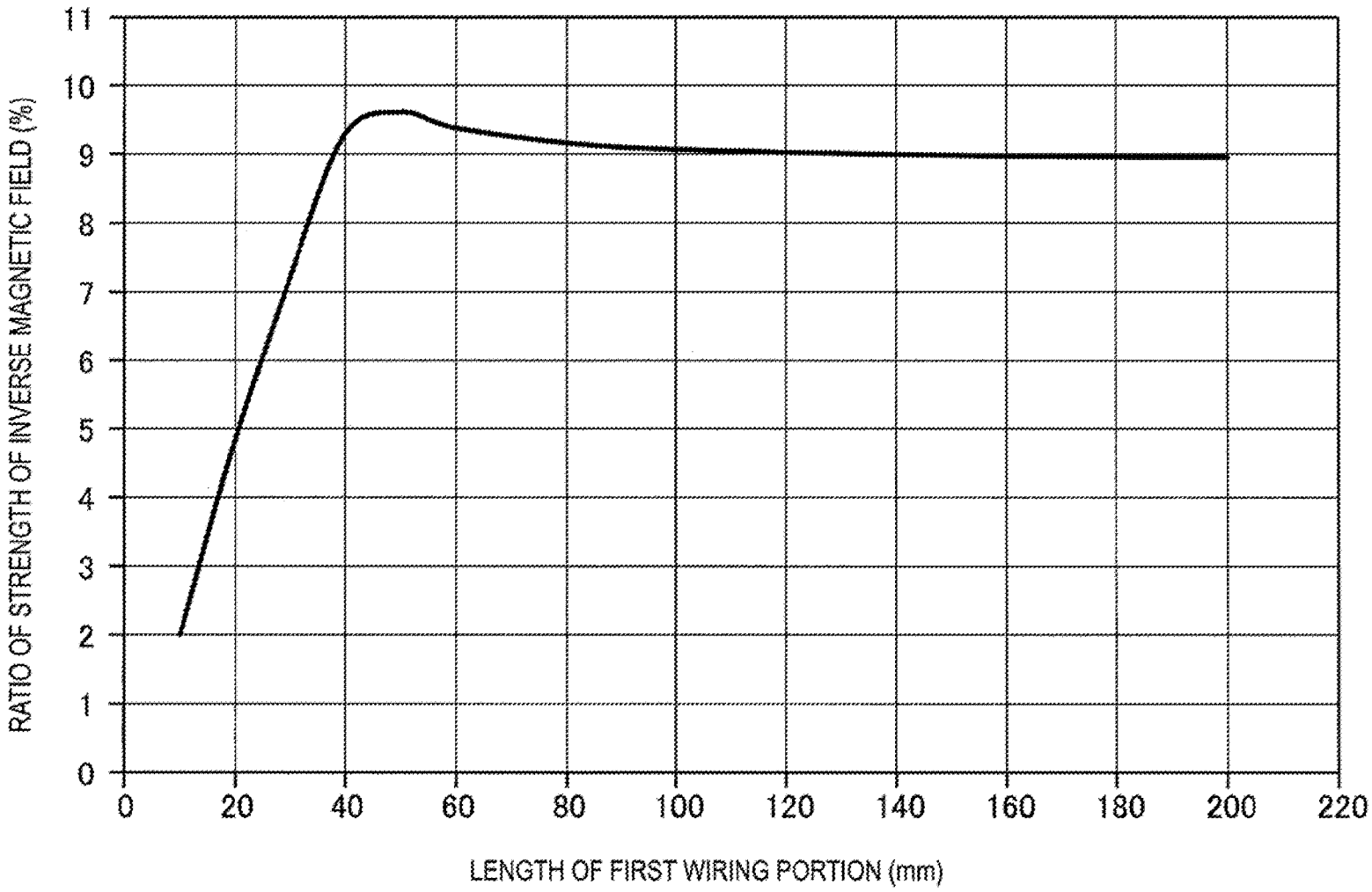
FIG. 12 is a graph illustrating a relationship, in Comparative Experiment 5, between the length of a first wire portion and the ratio of the strength of an inverse magnetic field.

A second embodiment of the present invention will be described with reference to FIG. 10 to FIG. 12. In the second embodiment, the configuration of the lead-out wire portions 119 is modified. Redundant descriptions of structures, operations, and effects similar to those of the first embodiment are omitted.

Figure 10:
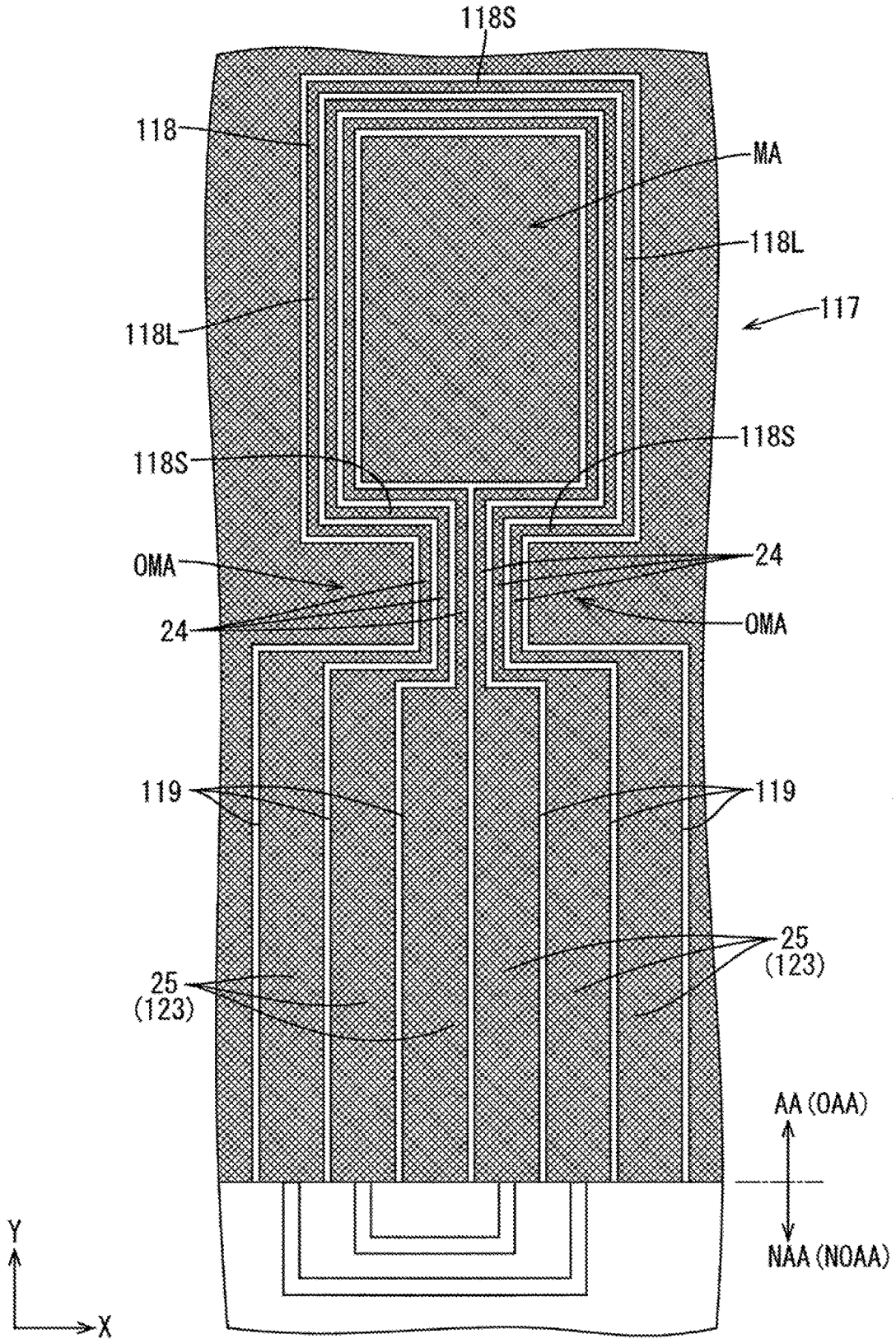
FIG. 10 is a plan view of the transparent antenna according to a second embodiment of the present invention.

Lead-out wire portions 119 of the transparent antenna 117 according to the present embodiment, as illustrated in FIG. 10, include first wire portions 24 connected with an antenna body portion 118, and second wire portions 25 which are disposed on the opposite side from the antenna body portion 118 with respect to the first wire portions 24, and which are connected with the first wire portions 24. The first wire portions 24 have the same line width as antenna element wires 121 constituting the antenna body portion 118. The first wire portions 24 have a constant line width throughout the length thereof, and may therefore be referred to as "constant line width portions". The first wire portions 24 include portions connected with the antenna body portion 118 and linearly extending along the Y-axis direction, the extending direction being perpendicular to short-side portions 118S which constitute the antenna body portion 118 and are connected with the first wire portions 24. The first wire portions 24 constituting those of the lead-out wire portions 119 which are disposed on the outermost position and the intermediate position are bent at substantially right angles such that the portions on the side connected with the second wire portions 25 extend along the X-axis direction, thus generally forming L-shape as viewed in plan. Accordingly, inverse magnetic field generating regions OMA between the first wire portions 24 and the short-side portions 118S connected therewith have a quadrilateral shape with substantially right-angle corners, as viewed in plan. The first wire portions 24 are configured so as to have a length dimension of not more than 21 mm. Accordingly, the dimension of the inverse magnetic field generating regions OMA with respect to the Y-axis direction is not more than 21 mm. That is, the dimension of the inverse magnetic field generating regions OMA with respect to the Y-axis direction is substantially equal to the length of the first wire portions 24.

On the other hand, the second wire portions 25 include large-width portions 123 of which the line width is greater than the line width of the antenna element wires 121 and the first wire portions 24. That is, the lead-out wire portions 119 partly include the large-width portions 123. The large-width portions 123 constituting the second wire portions 25 extend linearly along the Y-axis direction with a constant line width throughout the length thereof, and may therefore be referred to as "constant line width large-width portions". Preferably, the line width of the large-width portions 123 constituting the second wire portions 25 is approximately 4 to 5 times the line width of the antenna element wires 121 and the first wire portions 24. The second wire portions 25 arranged side by side along the X-axis direction have substantially the same line width. Because the line width of the second wire portions 25 is substantially the same and constant, the maximum outer width of the lead-out wire portions 119 corresponds to the width of the group of the second wire portions 25 arranged along the X-axis direction, and is constant regardless of the creepage distance thereof (the screen size of the liquid crystal panel).

In order to gain knowledge about how the Q-value of the transparent antenna 117 of the above-described configuration varies depending on the screen size of the liquid crystal panel, Comparative Experiment 4 was conducted as described below. In Comparative Experiment 4, Example 2 included the transparent antenna 117 provided with the large-width portions 123 and the lead-out wire portions 119 described in the foregoing paragraphs, and the Q-value of the transparent antenna 117 according to Example 2 was measured when used in a liquid crystal display device having a liquid crystal panel with various screen sizes. The results are shown in FIG. 11. In FIG. 11, the horizontal axis shows the screen size of the liquid crystal panel (in units of inches), and the vertical axis shows the Q-value of the transparent antenna (no unit). FIG. 11 also shows the plots of the comparative example and Example 1 in Comparative Experiment 1 according to the first embodiment. In FIG. 11, the solid line plot shows the experimental results for Example 2; the broken line plot shows the experimental results for the comparative example; and the dashed-and-double-dotted line plot shows the experimental results for Example 1. The transparent antennas according to the comparative example and Examples 1 and 2 were in each case configured with the antenna body portion disposed at the center position of the liquid crystal panel with respect to the Y-axis direction in each screen size of the liquid crystal panel. Accordingly, the greater the screen size, the longer the creepage distance of the lead-out wire portions became.

The experimental results for Comparative Experiment 4 will be described. According to the graph of FIG. 11, the Q-value of Example 2 is higher than in the comparative example and Example 1 at all times, and the decrease rate of the Q-value of the transparent antenna is smaller than in the comparative example and Example 1. Specifically, in Example 2, the Q-value is not less than 10 even when the screen size of the liquid crystal panel exceeded 55 inches. For example, at 60 inches, the Q-value is approximately 12. Accordingly, Example 2 is applicable to a liquid crystal display device equipped with a liquid crystal panel of screen size of up to at least 60 inches, and is also presumably applicable to screen sizes exceeding 60 inches. One reason that the Q-value of the transparent antenna 117 according to Example 2 has the above-described decrease rate believed to be because of the following. As the screen size of the liquid crystal panel becomes larger, the creepage distance of the lead-out wire portions 119 increases. However, of the lead-out wire portions 119, the line width of the first wire portions 24 connected with the antenna body portion 118 having the closed ring-shape is the same as the line width of the antenna element wires 121 of the antenna body portion 118. Accordingly, compared to if the first wire portions include large-width portions, the magnetic field generated in the magnetic field generation region MA of the antenna body portion 118 becomes stronger, whereby higher induced electromotive force can be obtained. In addition, the lead-out wire portions 119 are disposed on the opposite side from the antenna body portion 118 with respect to the first wire portions 24, and the second wire portions 25 connected with the first wire portions include the large-width portions 123. Accordingly, wire resistance is preferably decreased while ensuring the high induced electromotive force obtained due to the first wire portions 24, whereby the Q-value of the transparent antenna 117 is increased.

In order to gain knowledge about the relationship between the length of the first wire portions 24 constituting the lead-out wire portions 119 and the ratio of the strength of the inverse magnetic field due to the additional coil, Comparative Experiment 5 was conducted as described below. In Comparative Experiment 5, in the transparent antenna 117 including the lead-out wire portions 119 according to Example 2 of Comparative Experiment 4, the length of the first wire portions 24 in the extending direction thereof (the Y-axis direction) was varied in a range of 10 mm to 200 mm, and the ratio of the strength of the inverse magnetic field due to the additional coil to the strength of the normal magnetic field was measured. The results are shown in FIG. 12. In FIG. 12, the horizontal axis shows the length of the first wire portions 24 (in units of mm), and the vertical axis shows the ratio of the strength of the inverse magnetic field (in units of %).

The experimental results for Comparative Experiment 5 will be described. According to FIG. 12, it is seen that when the length of the first wire portions 24 was 10 mm to 40 mm, the ratio of the strength of the inverse magnetic field due to the additional coil tends to rapidly increase as the length increases. When the length is approximately 50 mm, the ratio of the strength of the inverse magnetic field reaches a peak (approximately 9.5%). When the length of the first wire portions 24 exceeds 50 mm, the ratio of the strength of the inverse magnetic field due to the additional coil slowly decreases. Beyond about 100 mm, the ratio of the strength of the inverse magnetic field becomes substantially constant (saturated) at approximately 9%. That is, it is believed that when the length of the first wire portions 24 exceeds 50 mm, the strength of the generated inverse magnetic field is not increased any more because the inverse magnetic field generating regions OMA become extended, whereas in the length range of 10 mm to 40 mm, the strength of the inverse magnetic field rapidly increases as the inverse magnetic field generating regions OMA are extended. It is also seen that when the length of the first wire portions 24 is greater than 21 mm, the ratio of the strength of the inverse magnetic field tends to exceed 5%, and the ratio of the strength of the inverse magnetic field tends to be 5% or lower when the length of the first wire portions 24 not more than 21 mm. Accordingly, in light of the experimental results for the first embodiment in Comparative Experiment 3, the decrease in the Q-value in the case where the device-side antenna is disposed so as to capture the inverse magnetic field can be sufficiently reduced by making the length of the first wire portions 24 not more than 21 mm so that the ratio of the strength of the inverse magnetic field is not more than 5%.

As described above, according to the present embodiment, the lead-out wire portions 119 include at least the first wire portions 24 connected with the antenna body portion 118, and the second wire portions 25 which are disposed on the opposite side from the antenna body portion 118 with respect to the first wire portions 24 and which are connected with the first wire portions 24. The first wire portions 24 have the same line width as that of the antenna body portion 118, while the second wire portions 25 have the large-width portions 123. Thus, of the lead-out wire portions 119, the line width of the first wire portions 24 connected with the antenna body portion 118 having the closed ring-shape is the same as the line width of the antenna body portion 118. Accordingly, compared to if the first wire portions include large-width portions, the magnetic field generated in the magnetic field generation region MA of the antenna body portion 118 becomes stronger, whereby higher induced electromotive force can be obtained. On the other hand, the second wire portions 25 which are connected with the first wire portions 24 and which are disposed on the opposite side from the antenna body portion 118 with respect to the first wire portions 24 include the large-width portions 123. Accordingly, wire resistance can be preferably decreased while ensuring the high induced electromotive force obtained with the first wire portions 24. In this way, higher antenna performance can be obtained.

The antenna body portion 118 includes the four side portion 118L, 118S forming a quadrilateral ring-shaped planar shape. The first wire portions 24 are connected with one of the short-side portions 118S constituting the antenna body portion 118, and extend along the direction perpendicular to the connected short-side portion 118S, the first wire portions 24 being configured to have a length dimension of not more than 21 mm. The first wire portions 24 of the lead-out wire portions 119 and the short-side portion 118S of the antenna body portion 118 that is connected with the first wire portions 24 may constitute an additional coil. Because the magnetic field generated by the additional coil ("the inverse magnetic field") has an opposite direction from that of the magnetic field generated in the magnetic field generation region MA on the inner side of the antenna body portion 118, antenna performance may potentially deteriorate. In particular, the first wire portions 24 are connected with one of the short-side portions 118S constituting the antenna body portion 118 having the quadrilateral ring-shaped planar shape and extend along a direction perpendicular to the short side 118S. Accordingly, compared to if the first wire portions are inclined with respect to the short side 118S, the inverse magnetic field tends to be increased, and antenna performance due to the inverse magnetic field may deteriorate to an unacceptable level when the length of the first wire portions 24 is greater than 21 mm. In this respect, when the length of the first wire portions 24 is set to not more than 21 mm, the region in which the inverse magnetic field is generated can be made sufficiently narrow, and the ratio of the inverse magnetic field can be sufficiently decreased. In this way, the deterioration in antenna performance due to the inverse magnetic field can be sufficiently reduced.

The large-width portions 123 also include the constant line width large-width portions of which the line width is constant. Because the large-width portions 123 constituting the second wire portions 25 include the constant line width large-width portions with the constant line width, the space in which the transparent antenna 117 is disposed can be made compact. This is suitable when the transparent antennas 117 are arranged side by side.

Third Embodiment

A third embodiment of the present invention will be described with reference to FIG. 13 or FIG. 14. In the third embodiment, the maximum outer width of lead-out wire portions 219 is modified from the first embodiment. Redundant descriptions of structures, operations, and effects similar to those of the first embodiment are omitted.

Figure 13:
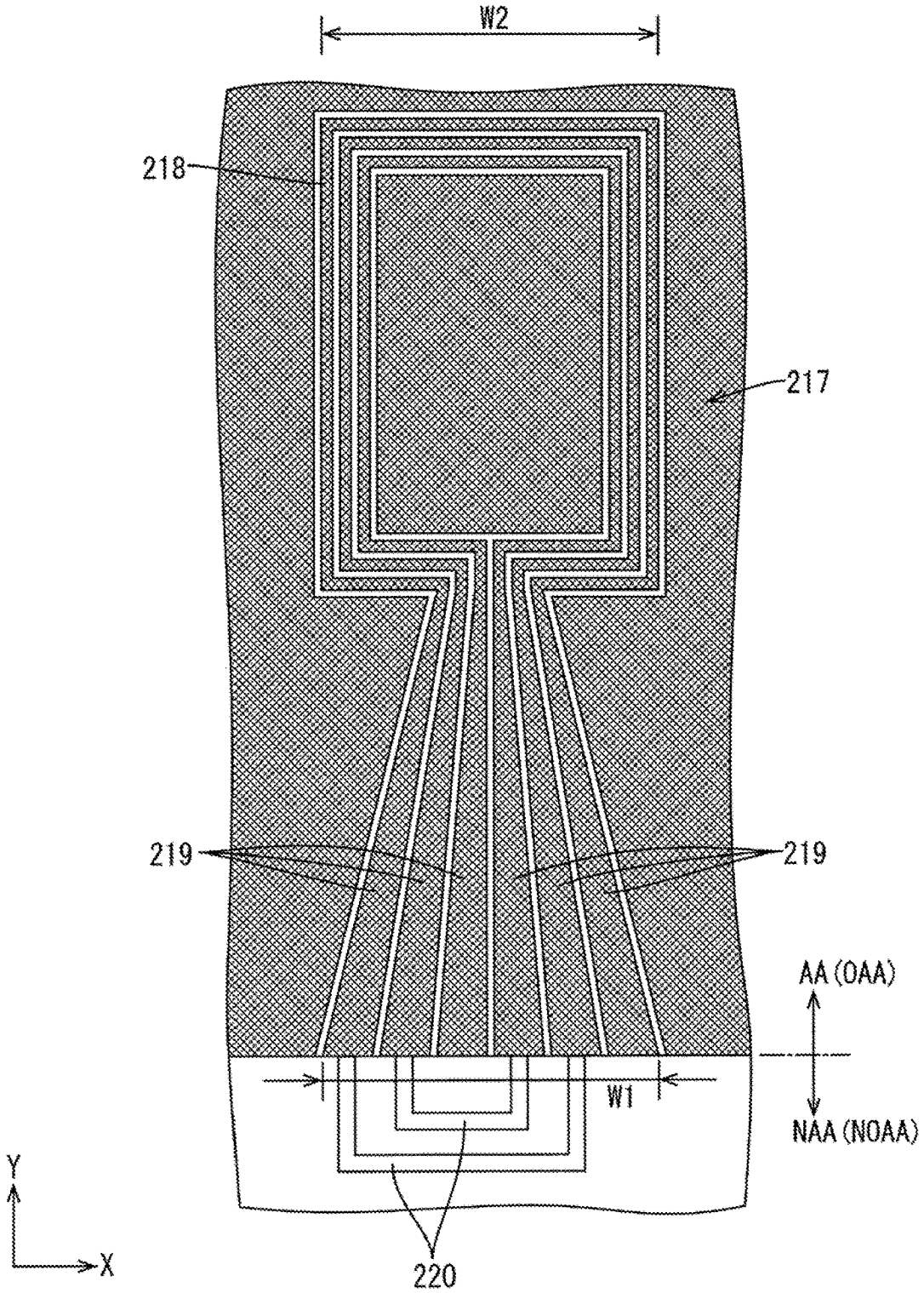
FIG. 13 is a plan view of the transparent antenna according to a third embodiment of the present invention.
Figure 14:
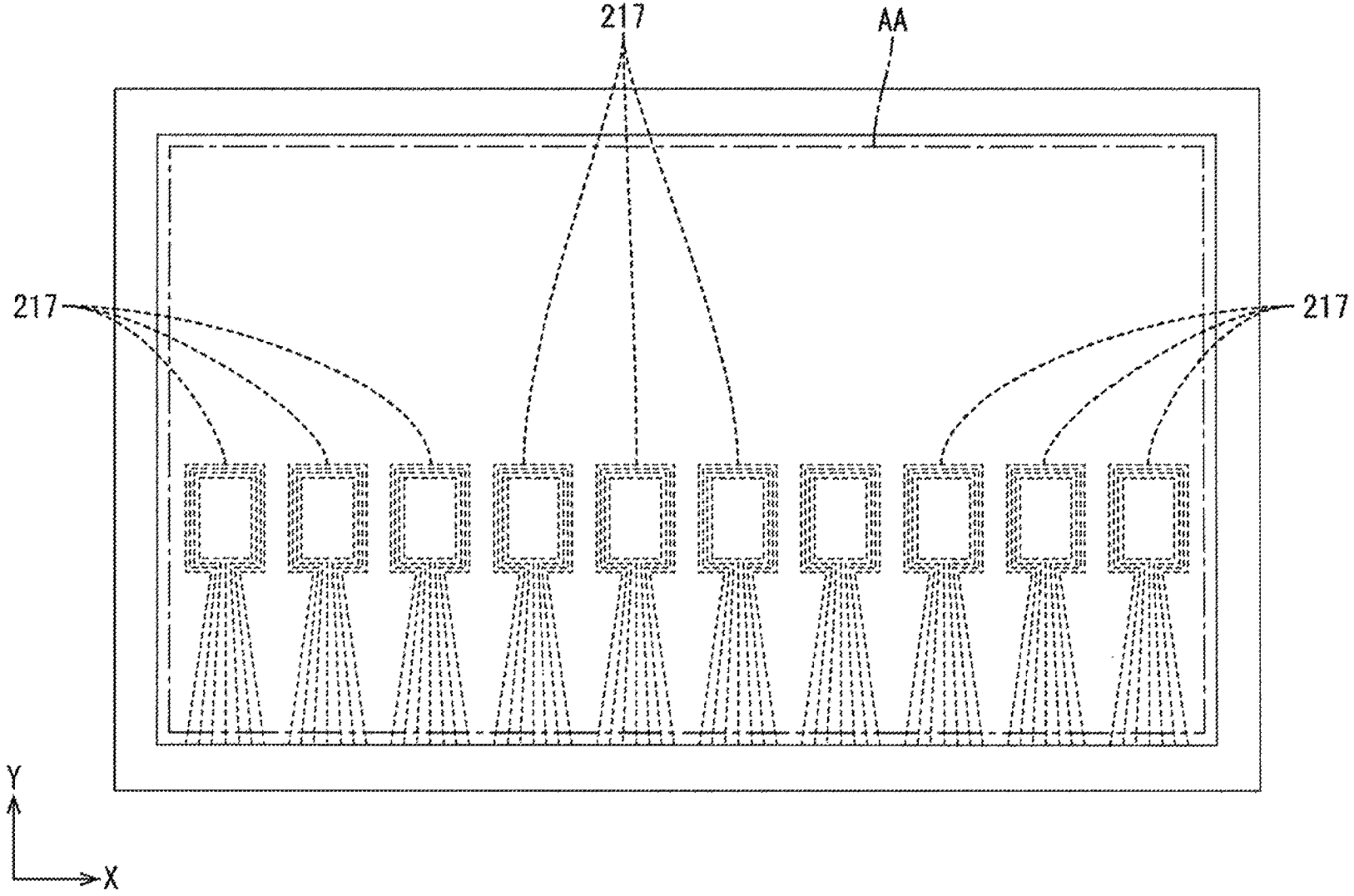
FIG. 14 is a front view of a liquid crystal display device.

As illustrated in FIG. 13, the lead-out wire portions 219 constituting the transparent antenna 217 according to the present embodiment have a maximum outer width W1 that is substantially the same as a maximum outer width W2 of an antenna body portion 218. As in the first embodiment, the lead-out wire portions 219 have the maximum line width on the end toward antenna connection wires 220. Accordingly, the maximum outer width W1 of a group of the lead-out wire portions 219 arranged side by side along the X-axis direction corresponds to the outer width on the end toward the antenna connection wires 220. In this configuration, the space in which the group of lead-out wire portions 219 is disposed with respect to the X-axis direction becomes the same as the corresponding space in which the antenna body portion 218 is disposed. Accordingly, as illustrated in FIG. 14, for example, the transparent antennas 217 can be arranged side by side in the X-axis direction in the display region AA of the liquid crystal panel efficiently.

As described above, according to the present embodiment, the lead-out wire portions 219 are arranged side by side, where the maximum outer width W1 of the plurality of lead-out wire portions 219 is the same as the maximum outer width W2 of the antenna body portion 218. In this way, the space in which the transparent antenna 217 is disposed can be made compact. This is preferable when the transparent antennas 217 are arranged side by side, for example.

Fourth Embodiment

A fourth embodiment of the present invention will be described with reference to FIG. 15. In the fourth embodiment, the configuration of the first embodiment is additionally provided with a touch panel 26 and a cover panel 27. Redundant descriptions of structures, operations, and effects similar to those of the first embodiment are omitted.

Figure 15:
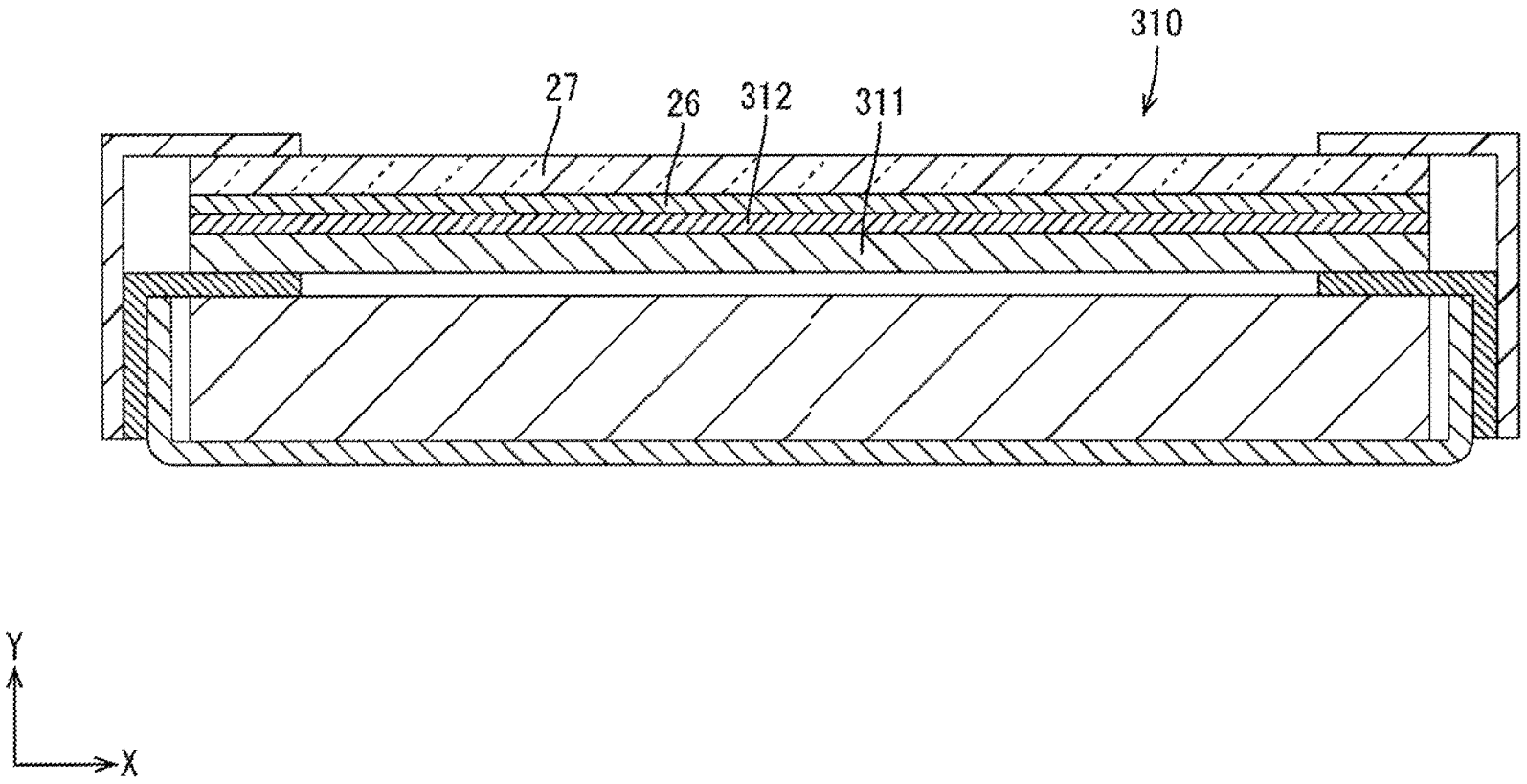
FIG. 15 is a cross sectional view illustrating a schematic configuration of a liquid crystal display device according to a fourth embodiment of the present invention.

As illustrated in FIG. 15, a liquid crystal display device 310 according to the present embodiment is provided with the touch panel 26 superposed on the upper side with respect to the transparent antenna substrate 312, i.e., on the opposite side from the liquid crystal panel 311, and the cover panel 27 further superposed on the upper side with respect to the touch panel 26. The touch panel 26 has dimensions and outline, as viewed in plan, which are substantially the same as those of the liquid crystal panel 311. The touch panel 26 is provided with a touch panel pattern (not illustrated) on a sheet surface thereof for detecting position information input by a user. The touch panel pattern on the touch panel 26 may preferably be of a projection-type capacitive system. The cover panel 27 is made of a substantially transparent board-shaped base material of glass having excellent optical transparency, such as, preferably, reinforced glass. The reinforced glass used for the cover panel 27 may preferably include chemically reinforced glass with a chemically reinforced layer surface provided by performing chemical reinforcement processing on the surface of the board-shaped glass base material. The cover panel 27 has high mechanical strength and shock resistance so that the touch panel 26, the transparent antenna substrate 312, and the liquid crystal panel 311 that are disposed on the backside can be more reliably prevented from being damaged or scratched.

Fifth Embodiment

A fifth embodiment of the present invention will be described with reference to FIG. 16. In the fifth embodiment, the configuration of lead-out wire portions 419 is modified from the second embodiment. Redundant descriptions of structures, operations, and effects similar to those of the second embodiment are omitted.

Figure 16:
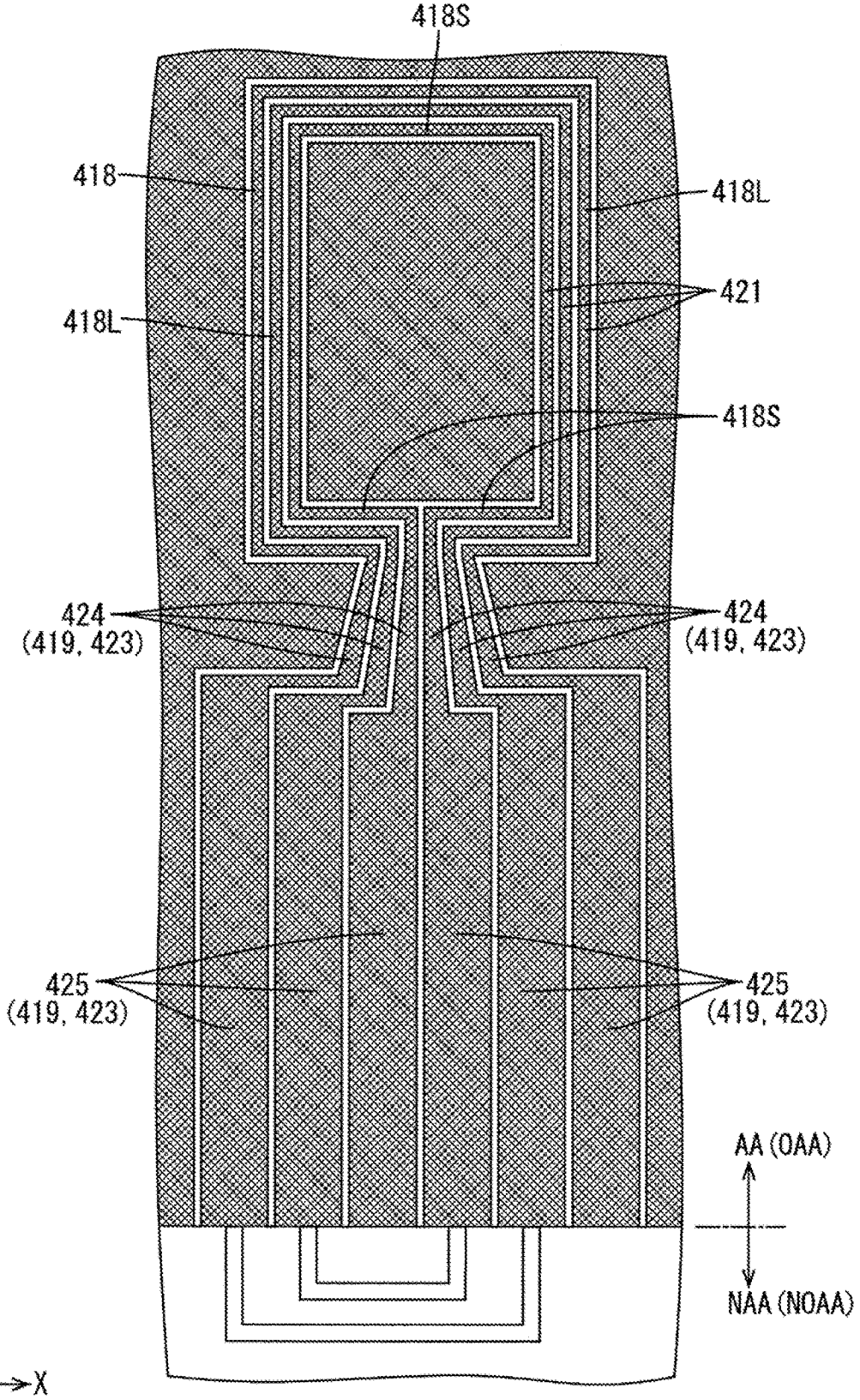
FIG. 16 is a plan view of the transparent antenna according to a fifth embodiment of the present invention.

As illustrated in FIG. 16, the lead-out wire portions 419 according to the present embodiment include first wire portions 424 with varying line widths and second wire portions 425 with a constant line width. The line widths of the first wire portions 424 are gradually increased with increasing distance from an antenna body portion 418, and the first wire portions 424 are inclined with respect to directions along side portions 418L, 418S constituting the antenna body portion 418. That is, the first wire portions 424 may be said to include "large-width portions 423" of which the line widths are greater than the line width of antenna element wires 421 constituting the antenna body portion 418; "line width-varying large-width portions" of which the line widths are varying in accordance with the position with respect to the extending direction; or "inclined large-width portions" that extend with inclined outer edges. The first wire portions 424 are configured to form an inclination angle of not less than 14 degrees, specifically approximately 14 degrees to 15 degrees, with respect to the direction perpendicular to the short-side portion 418S of the antenna body portion 418 with which the first wire portions 424 are connected, i.e., with respect to the Y-axis direction. The second wire portions 425 include, as in the case of the second embodiment, "the large-width portions 423" of which the line width is greater than the line width of the antenna element wires 421 constituting the antenna body portion 418, and the "constant line width large-width portions" of which the line width is constant throughout the length thereof. Accordingly, the lead-out wire portions 419 may be said to entirely include "the large-width portions 423" including the first wire portions 424 and the second wire portions 425 of which the line widths are greater than the line width of antenna element wires 421 constituting the antenna body portion 418. In this configuration, the wire resistance associated with the lead-out wire portions 419 can be preferably decreased; in addition, the ratio of the strength of the inverse magnetic field can be preferably decreased by the first wire portions 424, and the space in which the transparent antenna 417 is disposed can be made compact due to the second wire portions 425.

Sixth Embodiment

A sixth embodiment of the present invention will be described with reference to FIG. 17. In the sixth embodiment, the configuration of lead-out wire portions 519 is modified from the second embodiment. Redundant descriptions of structures, operations, and effects similar to those of the second embodiment are omitted.

Figure 17:
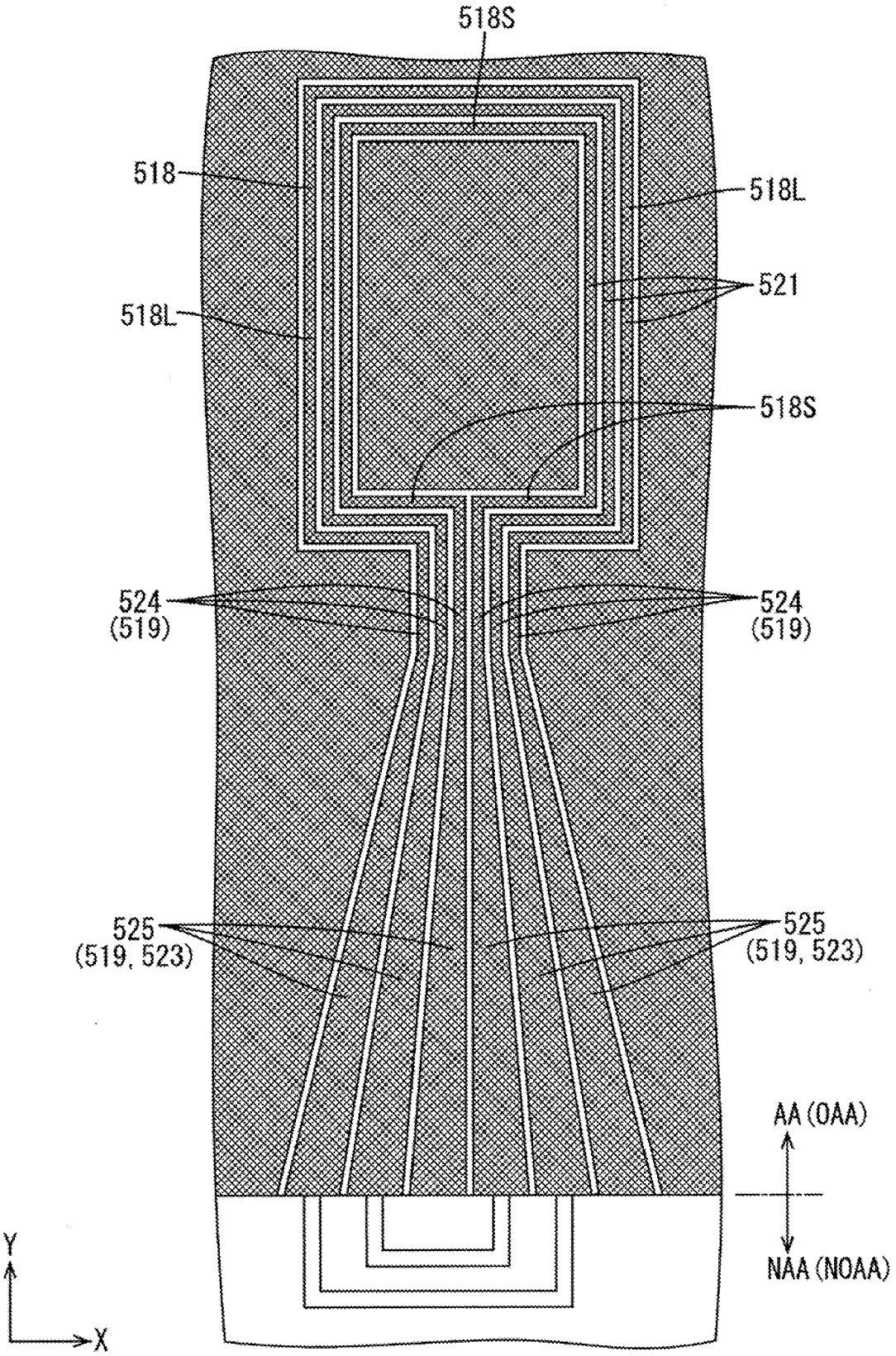
FIG. 17 is a plan view of the transparent antenna according to a sixth embodiment of the present invention.

As illustrated in FIG. 17, the lead-out wire portions 519 according to the present embodiment includes first wire portions 524 with a constant line width, and second wire portions 525 with varying line widths. The first wire portions 524, as in the case of the second embodiment, include "constant line width portions" of which the line width is substantially the same as the line width of antenna element wires 521 constituting the antenna body portion 518, and is constant throughout the length thereof. The second wire portions 525 have the line width gradually increasing with increasing distance from the antenna body portion 518 and the first wire portions 524, and are inclined with respect to directions along side portions 518L, 518S constituting the antenna body portion 518. That is, the second wire portions 525 may be said to include: "large-width portions 523" of which the line width is greater than the line width of the antenna element wires 521 constituting the antenna body portion 518; "line width-varying large-width portions" of which the line width is varied in accordance with the position with respect to the extending direction; or "inclined large-width portions" that extend with inclined outer edges. In this configuration, the induced electromotive force of the antenna body portion 518 can be increased by the first wire portions 524, and the wire resistance associated with the lead-out wire portions 519 can be preferably decreased by the second wire portions 525.

Seventh Embodiment

A seventh embodiment of the present invention will be described with reference to FIG. 18. In the seventh embodiment, the configuration of lead-out wire portions 619 is modified from the second embodiment. Redundant descriptions of structures, operations, and effects similar to those of the second embodiment are omitted.

Figure 18:
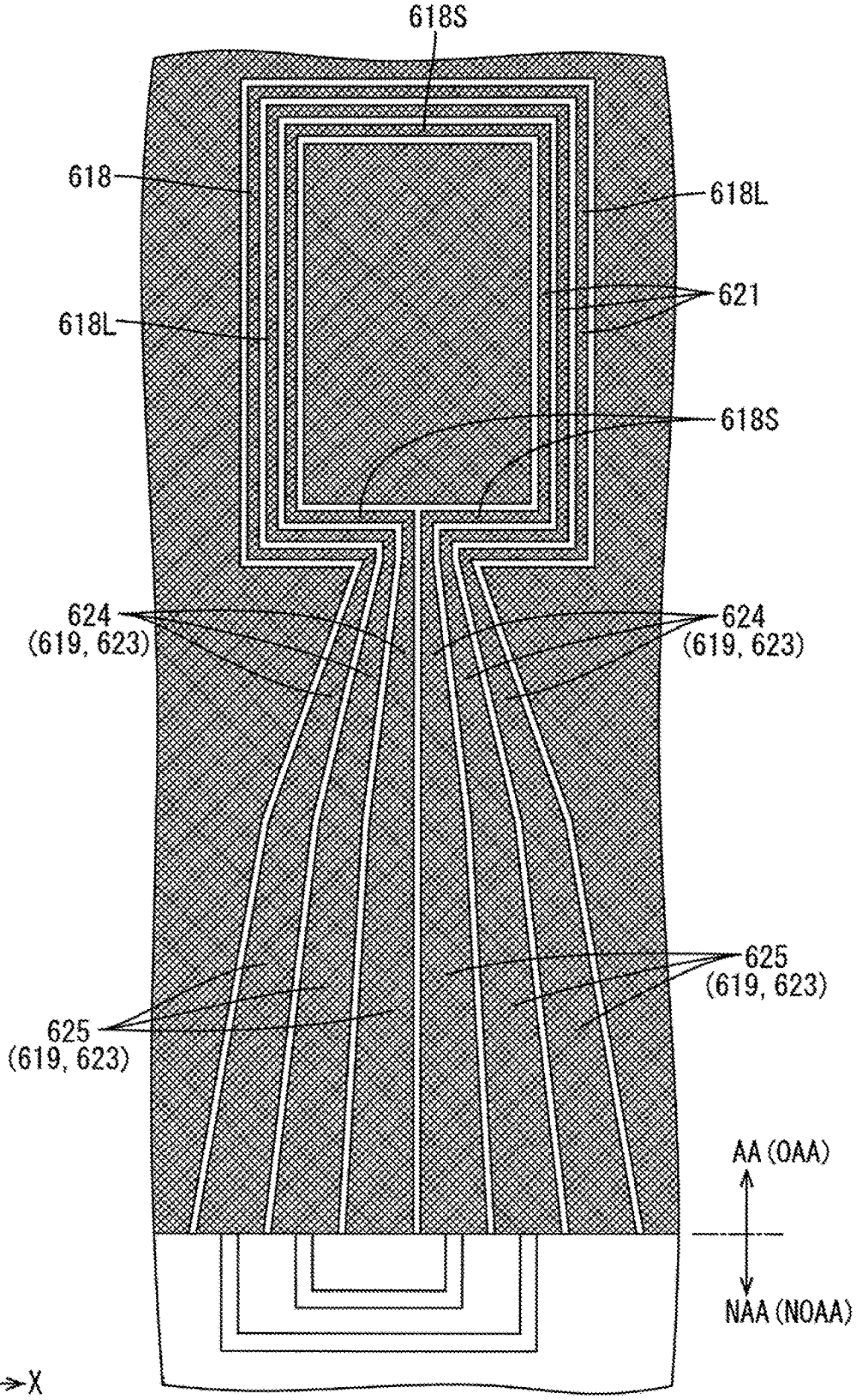
FIG. 18 is a plan view of the transparent antenna according to a seventh embodiment of the present invention.

As illustrated in FIG. 18, the lead-out wire portions 619 according to the present embodiment include first wire portions 624 with varying line widths, and second wire portions 625 with varying line widths of which the rate of change is smaller than that of the first wire portions 624. The first wire portions 624 have the line widths gradually increasing with increasing distance from an antenna body portion 618, and are inclined with respect to the direction along side portions 618L, 618S constituting the antenna body portion 618. That is, the first wire portions 624 may be said to include: "large-width portions 623" of which the line widths are greater than the line width of antenna element wires 621 constituting the antenna body portion 618; "line width-varying large-width portions" with varying line widths in accordance with the position with respect to the extending direction; or "inclined large-width portions" extending with inclined outer edges. The first wire portions 624 are configured to form an inclination angle of approximately 20 degrees with respect to the direction perpendicular to the short-side portion 618S of the antenna body portion 618 with which the first wire portions 624 are connected, i.e., with respect to the Y-axis direction. The second wire portions 625 have the line widths gradually increasing with increasing distance from the antenna body portion 618 and the first wire portions 624, and are inclined with respect to the direction along the side portions 618L, 618S constituting the antenna body portion 618. The rate of change in the line widths of the second wire portions 625 is smaller than the rate of change in the line widths of the first wire portions 624. Accordingly, the second wire portions 625 are configured so as to form inclination angles of, specifically, approximately 14 degrees to 15 degrees, for example, with respect to the Y-axis direction, the inclination angles being smaller than the corresponding inclination angles of the first wire portions 624. The second wire portion 626 may be said to include, as in the case of the first wire portions 624: "large-width portions 623", "line width-varying large-width portions", or "inclined large-width portions". In this configuration, because of the first wire portions 624 having greater inclination angles with respect to the Y-axis direction than in the lead-out wire portions 19 according to the first embodiment, the ratio of the strength of the inverse magnetic field can be more preferably decreased. In addition, by the second wire portions 625 having smaller inclination angles with respect to the Y-axis direction than the first wire portions 624, the space in which the transparent antenna 617 is disposed can be made compact.

Eighth Embodiment

An eighth embodiment of the present invention will be described with reference to FIG. 19. In the eighth embodiment, the configuration of lead-out wire portions 719 is modified from the first embodiment. Redundant descriptions of structures, operations, and effects similar to those of the first embodiment are omitted.

Figure 19:
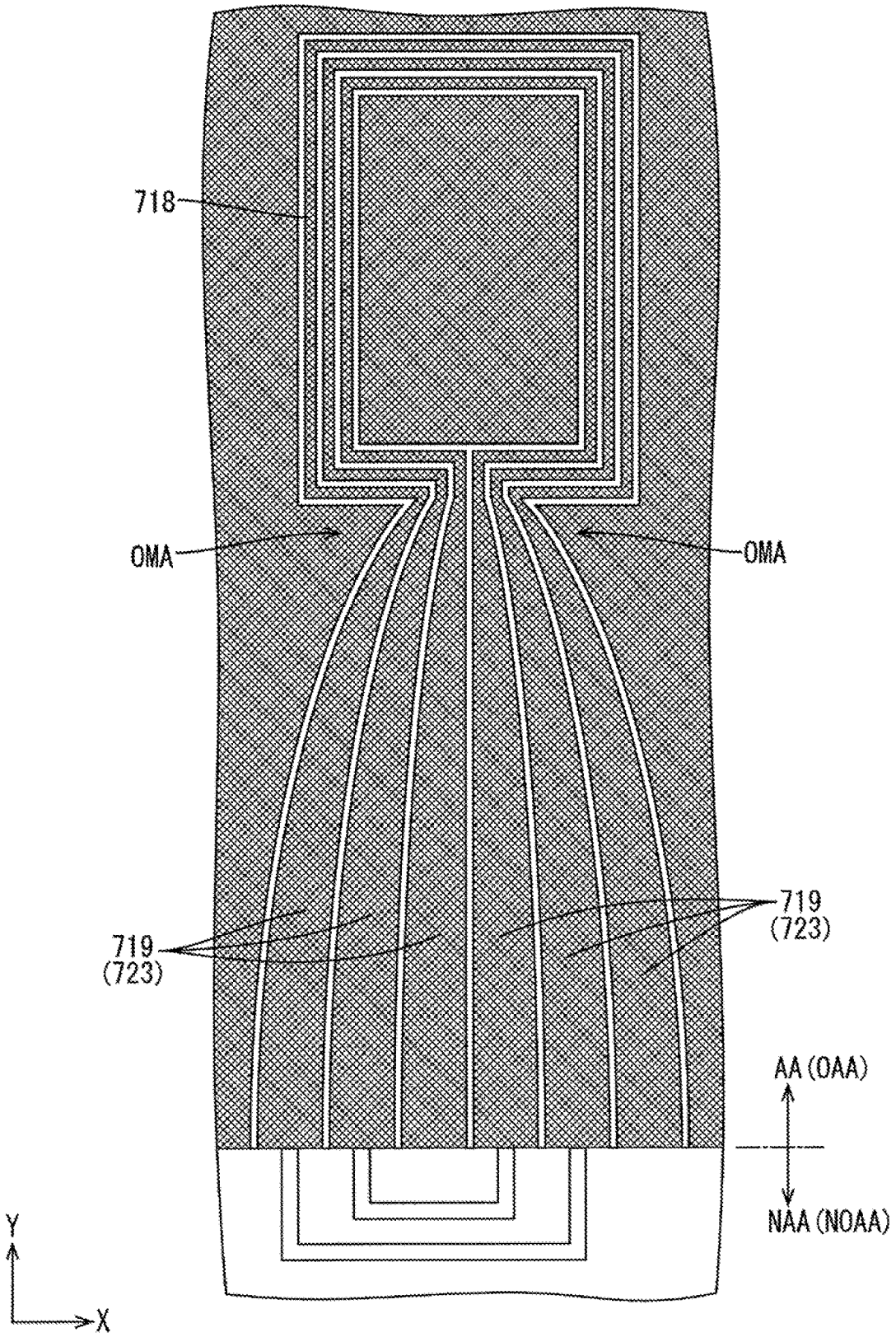
FIG. 19 is a plan view of the transparent antenna according to an eighth embodiment of the present invention.

As illustrated in FIG. 19, large-width portions 723 constituting the lead-out wire portions 719 according to the present embodiment have curved outer edges curving in substantially arc-shape. The large-width portions 723 are configured with line widths gradually increasing with increasing distance from the antenna body portion 718, the rate of change in the line width gradually decreasing with increasing distance from an antenna body portion 718. In this way, the area of the inverse magnetic field generating regions OMA in which the inverse magnetic field is generated can be preferably reduced, whereby the ratio of the strength of the inverse magnetic field can be preferably decreased.

Ninth Embodiment

A ninth embodiment of the present invention will be described with reference to FIG. 20. In the ninth embodiment, the configuration of lead-out wire portions 819 is modified from the eighth embodiment. Redundant descriptions of structures, operations, and effects similar to those of the eighth embodiment are omitted.

Figure 20:
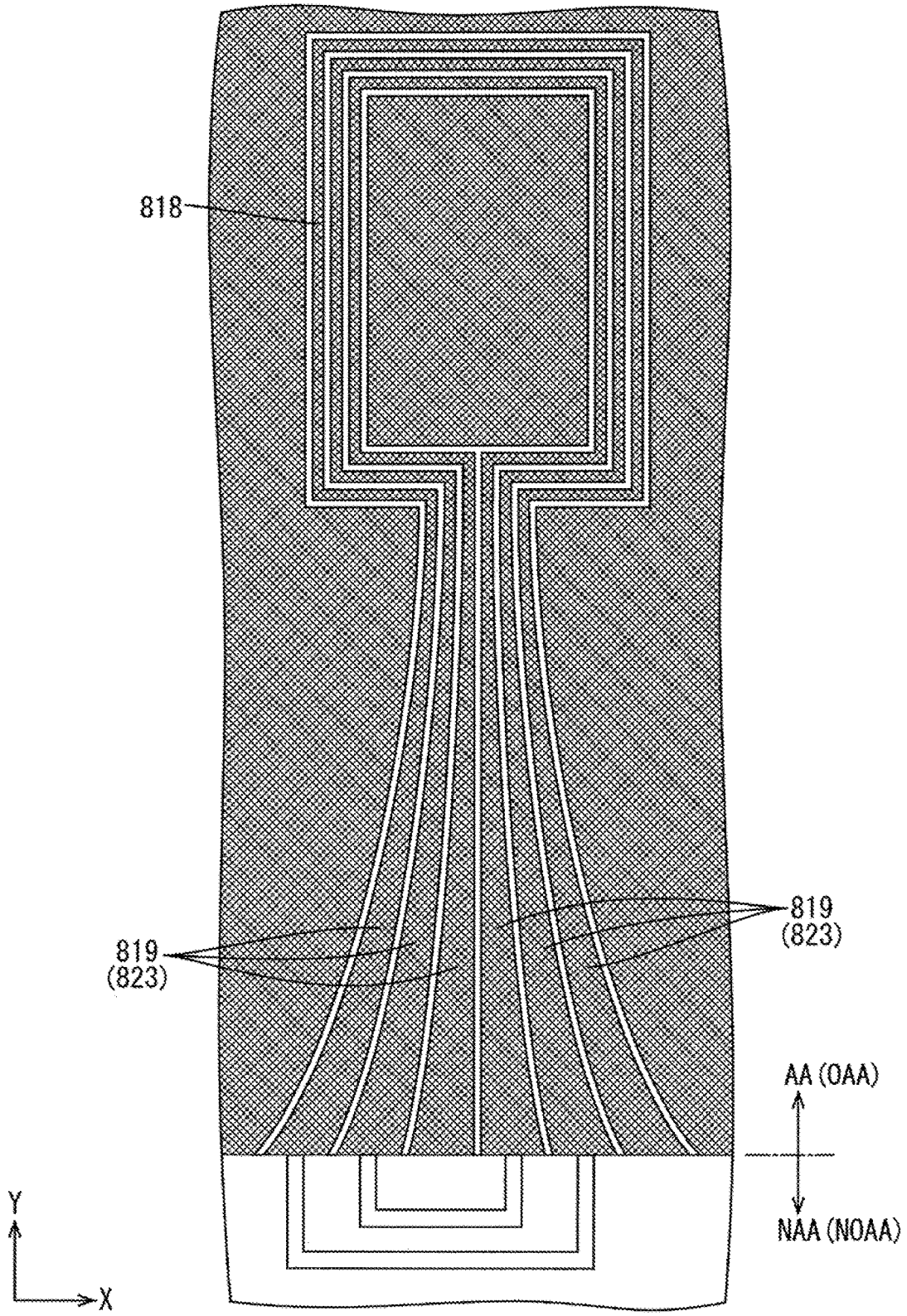
FIG. 20 is a plan view of the transparent antenna according to a ninth embodiment of the present invention.

As illustrated in FIG. 20, large-width portions 823 constituting the lead-out wire portions 819 according to the present embodiment are configured with line widths gradually increasing with increasing distance from an antenna body portion 818, the rate of change in the line widths gradually increasing with increasing distance from the antenna body portion 818.

Tenth Embodiment

A tenth embodiment of the present invention will be described with reference to FIG. 21. In the tenth embodiment, the configuration of lead-out wire portions 919 is modified from the second embodiment. Redundant descriptions of structures, operations, and effects similar to those of the second embodiment are omitted.

Figure 21:
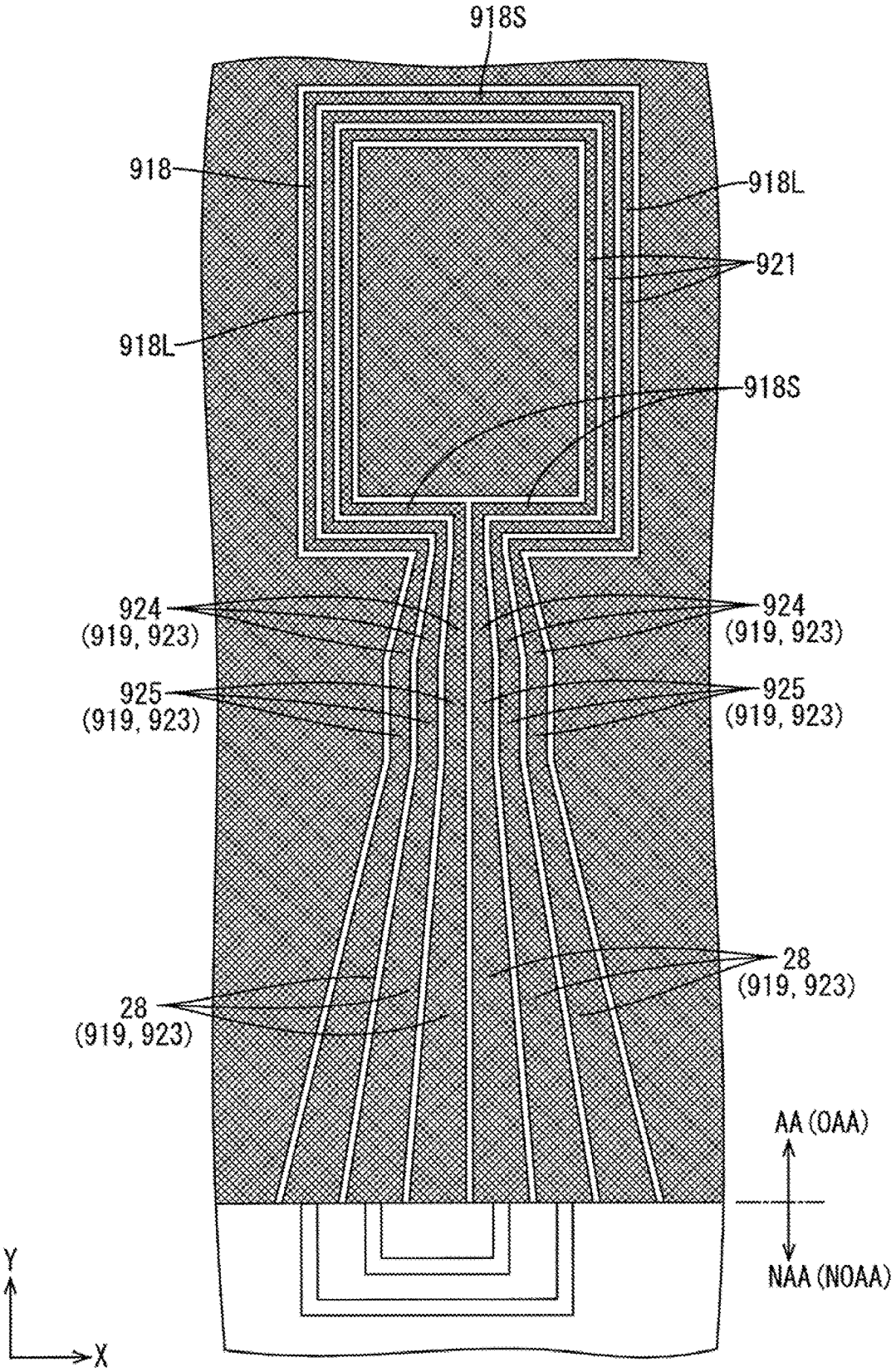
FIG. 21 is a plan view of the transparent antenna according to a tenth embodiment of the present invention.

As illustrated in FIG. 21, the lead-out wire portions 919 according to the present embodiment include first wire portions 924 continuous with an antenna body portion 918; second wire portions 925 which are disposed on the opposite side from the antenna body portion 918 with respect to the first wire portions 924, and which are continuous with the first wire portions 924; third wire portions 28 which are disposed on the opposite side from the first wire portions 924 with respect to the second wire portions 925, and which are continuous with the second wire portions 925. The first wire portions 924 and the third wire portions 28 have line widths gradually increasing with increasing distance from the antenna body portion 918, and are inclined with respect to directions along side portions 918L, 918S constituting the antenna body portion 918. That is, the first wire portions 924 and the third wire portions 28 may be said to include: "large-width portions 923" of which the line widths are greater than the line width of antenna element wires 921 constituting the antenna body portion 918; "line width-varying large-width portions" with line widths varying in accordance with the position with respect to the extending direction; and "inclined large-width portions" extending with inclined outer edges. The first wire portions 924 are configured to form an inclination angle of not less than 14 degrees, specifically approximately 14 degrees to 15 degrees, with respect to the direction perpendicular to the short-side portion 918S of the antenna body portion 918 with which the first wire portions 924 are connected, i.e., with respect to the Y-axis direction. The second wire portions 925, as in the case of the second embodiment, include the "large-width portions 923" of which the line widths are greater than the line widths of the antenna element wires 921 constituting the antenna body portion 918, and the "constant line width large-width portions" of which the line width is constant throughout the length thereof. The third wire portions 28 have a minimum line width that is greater than a maximum line width of the first wire portions 924, and that is greater than the line width of the second wire portions 925. Accordingly, the lead-out wire portions 919 may be said to entirely include the "large-width portions 923" including the first wire portions 924, the second wire portions 925, and the third wire portions 28 all of which the line widths are greater than the line width of the antenna element wires 921 constituting the antenna body portion 918.

Eleventh Embodiment

An eleventh embodiment of the present invention will be described with reference to FIG. 22. In the eleventh embodiment, the configuration of lead-out wire portions 1019 is modified from the tenth embodiment. Redundant descriptions of structures, operations, and effects similar to those of the tenth embodiment are omitted.

Figure 22:
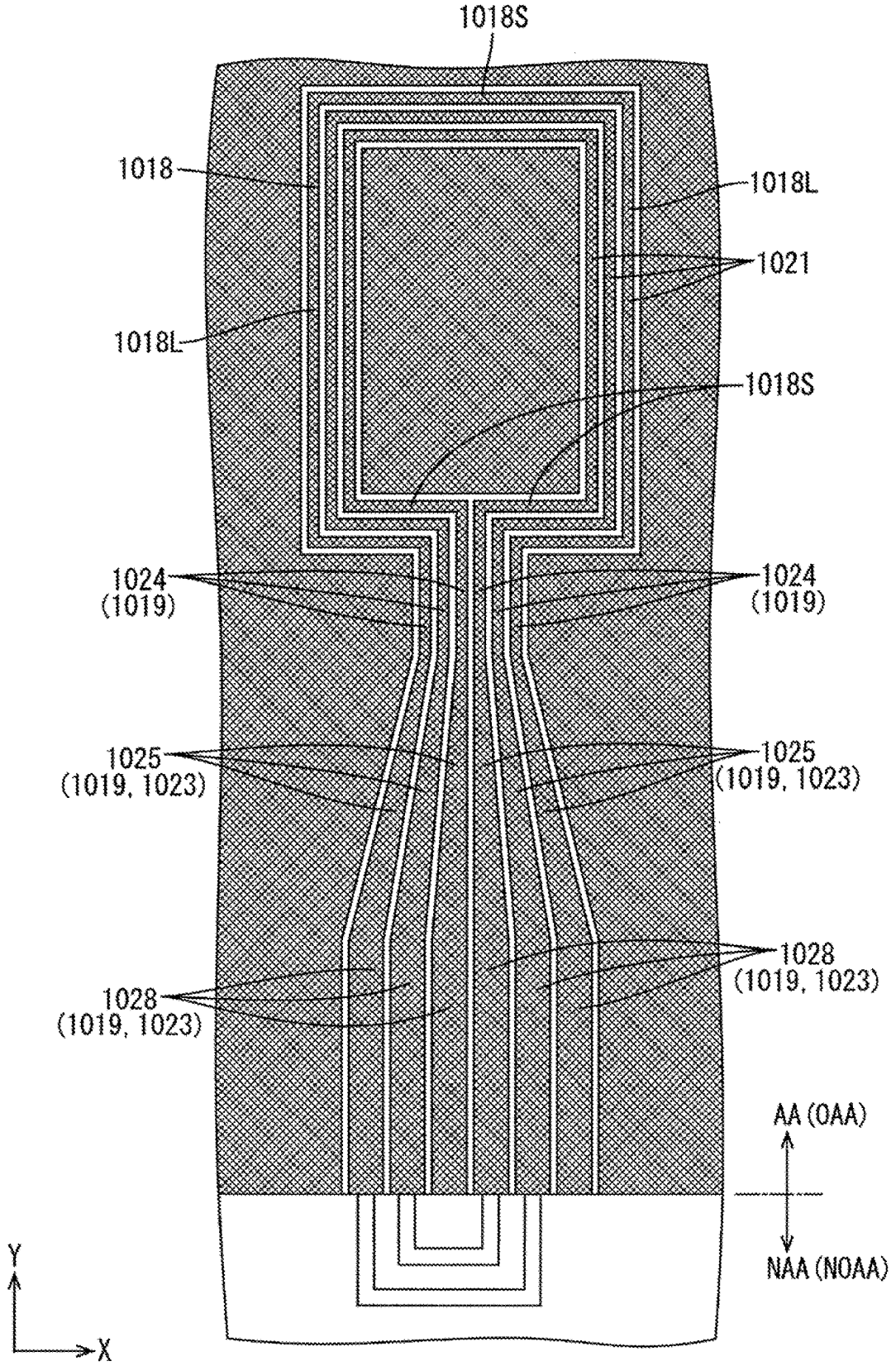
FIG. 22 is a plan view of the transparent antenna according to an eleventh embodiment of the present invention.

As illustrated in FIG. 22, the lead-out wire portions 1019 according to the present embodiment include first wire portions 1024 with a constant line width; second wire portions 1025 with varying line widths; and third wire portions 1028 with a constant line width. The first wire portions 1024, as in the case of the second embodiment, include "constant line width portions" of which the line width is substantially the same as the line width of antenna element wires 1021 constituting an antenna body portion 1018, and constant throughout the length thereof. The second wire portions 1025 have the line widths gradually increasing with increasing distance from the antenna body portion 1018 and the first wire portions 1024, and are inclined with respect to directions along side portions 1018L, 1018S constituting the antenna body portion 1018. That is, the second wire portions 1025 may be said to include "large-width portions 1023" of which the line widths are greater than the line width of the antenna element wires 1021 constituting the antenna body portion 1018; "line width-varying large-width portions" with line widths varying in accordance with the position with respect to the extending direction; and "inclined large-width portions" extending with inclined outer edges. The third wire portions 1028 include "large-width portions 1023" of which the line widths are greater than the line width of the antenna element wires 1021 constituting the antenna body portion 1018, and "constant line width large-width portions" of which the line width is constant throughout the length thereof.

Twelfth Embodiment

A twelfth embodiment of the present invention will be described with reference to FIG. 23. In the twelfth embodiment, the configuration of lead-out wire portions 1119 is modified from the eleventh embodiment. Redundant descriptions of structures, operations, and effects similar to those of the eleventh embodiment are omitted.

Figure 23:
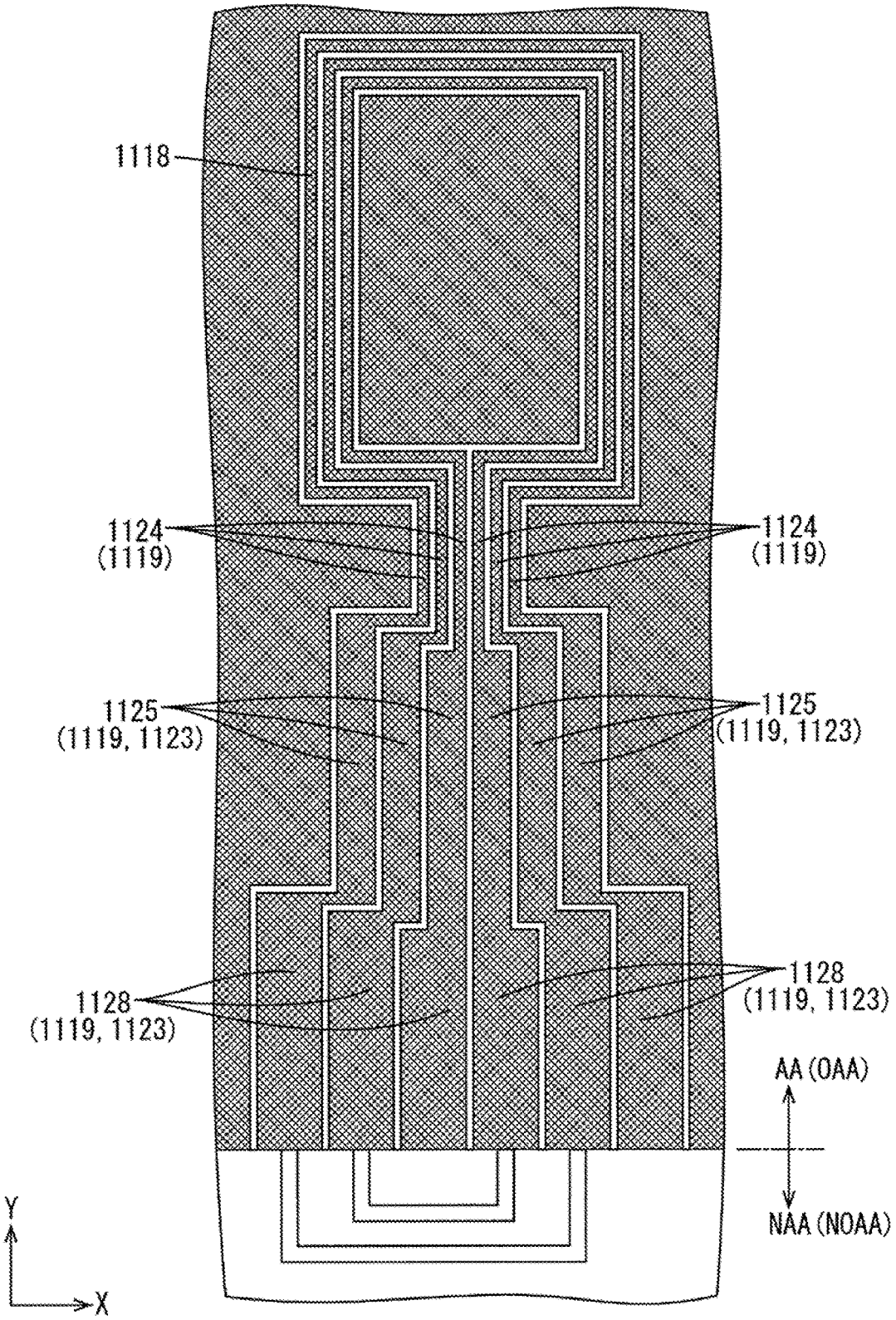
FIG. 23 is a plan view of the transparent antenna according to a twelfth embodiment of the present invention.

As illustrated in FIG. 23, the lead-out wire portions 1119 according to the present embodiment include first wire portions 1124, second wire portions 1125, and third wire portions 1128 of which the line widths are respectively different but all constant. The first wire portions 1124, as in the case of the second embodiment, include "constant line width portions" of which the line width is substantially the same as the line width of antenna element wires 1121 constituting the antenna body portion 1118, and constant throughout the length thereof. The second wire portions 1125 include "large-width portions 1123" of which the line width is greater than the line width of the antenna element wires 1121 constituting the antenna body portion 1118 and the line width of the first wire portions 1124, and "constant line width large-width portions" with a constant line width throughout the length thereof. The third wire portions 1128 include "large-width portions 1123" of which the line width is greater than the line width of the second wire portions 1125, and "constant line width large-width portions" of which the line width is constant throughout the length thereof. That is, the lead-out wire portions 1119 may be said to be configured with the line width becoming successively wider in steps with increasing distance from the antenna body portion 1118.

Thirteenth Embodiment

A thirteenth embodiment of the present invention will be described with reference to FIG. 24. In the thirteenth embodiment, the configuration of lead-out wire portions 1219 is modified from the tenth embodiment. Redundant descriptions of structures, operations, and effects similar to those of the tenth embodiment are omitted.

Figure 24:
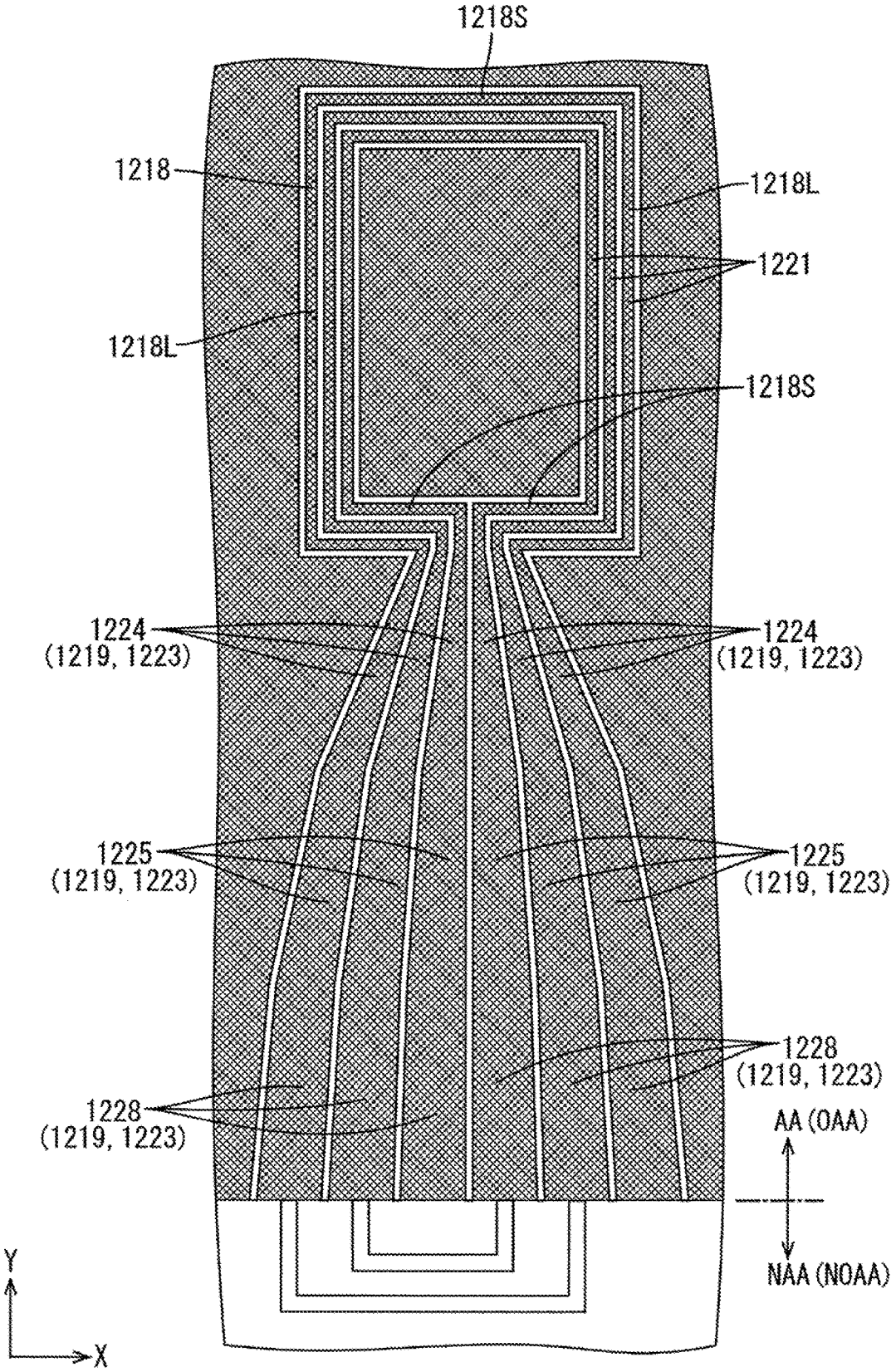
FIG. 24 is a plan view of the transparent antenna according to a thirteenth embodiment of the present invention.

As illustrated in FIG. 24, the lead-out wire portions 1219 according to the present embodiment are configured with first wire portions 1224, second wire portions 1225, and third wire portions 1228 all of which have line widths becoming wider with increasing distance from an antenna body portion 1218. The first wire portions 1224 have line widths gradually increasing with increasing distance from the antenna body portion 1218, and are inclined with respect to the direction alongside portions 1218L, 1218S constituting the antenna body portion 1218. That is, the first wire portions 1224 may be said to include "large-width portions 1223" of which the line widths are greater than the line widths of the antenna element wire 1221 constituting the antenna body portion 1218; "line width-varying large-width portions" of which the line widths are varying in accordance with the position with respect to the extending direction; and "inclined large-width portion" extending with inclined outer edges. The first wire portions 1224 are configured so as to form an inclination angle of approximately 20 degrees with respect to the direction perpendicular to the short-side portion 1218S of the antenna body portion 1218 with which the first wire portions 1224 are connected, i.e., with respect to the Y-axis direction. The second wire portions 1225 have the line widths gradually increasing with increasing distance from the first wire portions 1224, and are inclined with respect to the directions along the side portions 1218L, 1218S constituting the antenna body portion 1218. The rate of change in the line widths of the second wire portions 1225 is smaller than the rate of change in the line widths of the first wire portions 1224. Accordingly, the second wire portions 1225 are configured so as to form inclination angles of, specifically, approximately 14 degrees to 15 degrees, for example, with respect to the Y-axis direction, the inclination angles being smaller than the corresponding inclination angle of the first wire portions 1224. The second wire portion 1226, as in the case of the first wire portions 1224, may be said to include "large-width portions 1223"; "line width-varying large-width portions", and "inclined large-width portions". The third wire portions 1228 have the line widths gradually increasing with increasing distance from the second wire portions 1225, and are inclined with respect to the direction along the side portions 1218L, 1218S constituting the antenna body portion 1218. The rate of change in the line widths of the third wire portions 1228 is smaller than the rate of change in the line widths of the second wire portions 1225. Accordingly, the third wire portions 1228 are configured so as to form inclination angles of, specifically, approximately 10 degrees, for example, with respect to the Y-axis direction, the inclination angles being smaller than the corresponding inclination angles of the second wire portions 1225. The third wire portions 1228 may be said to include, as in the case of the first wire portions 1224 and the second wire portions 1225, "large-width portions 1223"; "line width-varying large-width portions"; and "inclined large-width portions".

Other Embodiments

The present invention is not limited to the above embodiments explained in the above description and described with reference to the drawings. The following embodiments may be included in the technical scope of the present invention, for example.

(1) In the foregoing embodiments, the transparent antenna is configured from meshed metal film. However, the transparent antenna may include a composite conductive film of meshed metal film with a transparent electrode film (ITO) laminated thereon. By using the composite conductive film in the transparent antenna, the wire resistance of the transparent antenna can be further decreased.

(2) Other than the foregoing embodiments, concrete numerical values may be modified as appropriate, such as the inclination angle of the inclined large-width portion; the rate of change in the line width of the line width-varying large-width portion; the length of the first wire portion; the line widths of the constant line width large-width portion and the constant line width portion; and the diagonal pitch of the mesh of the meshed metal film. It is also possible to modify, as appropriate, the dimensional relationship between the maximum outer width of the antenna body portion and the maximum outer width of the lead-out wire portion; for example, the latter may be greater than the former, or the former may be greater than the latter.

(3) In the foregoing embodiments, the configuration has been described in which the transparent antenna is disposed at around the center position of the liquid crystal panel with respect to the Y-axis direction. However, the specific location of the transparent antenna with respect to the X-axis direction and the Y-axis direction in the plane of the liquid crystal panel may be modified as appropriate. For example, the transparent antenna may be disposed on the upper side or lower side of the center position with respect to the Y-axis direction in the plane of the liquid crystal panel, or may be disposed around the center position with respect to the X-axis direction.

(4) In the foregoing embodiments, the case has been described in which the antenna body portion has a longitudinal quadrilateral planar shape. However, the planar shape of the antenna body portion may be laterally long quadrilateral or square, for example. In other examples, the planar shape of the antenna body portion may be circular or oval.

(5) In the foregoing embodiments, the configuration has been described in which the lead-out wire portion extends from the antenna body portion downward of the liquid crystal display device with respect to the Y-axis direction. However, a configuration may be adopted in which the lead-out wire portion extends from the antenna body portion upward of the liquid crystal display device with respect to the Y-axis direction. In another configuration, the lead-out wire portion may extend from the antenna body portion toward either right or left of the liquid crystal display device with respect to the X-axis direction. In this case, the arrangement of the antenna body portion may preferably be rotated by 90 degrees.

(6) In the foregoing embodiments, the configuration has been described in which the antenna body portion is made of three antenna element wires. However, the number of antenna element wires (turns) of the antenna body portion may be modified as appropriate. When the number of the antenna element wires is modified, the number of the lead-out wire portions or the antenna connection wire portions may also be modified as appropriate.

(7) In the foregoing embodiments, the case has been described in which the transparent antenna has a symmetric shape. However, the transparent antenna may have an asymmetric shape.

(8) In the foregoing embodiments, the antenna body portion has been described as including a closed ring-shape circumscribing the magnetic field generating region. However, the present invention is also applicable to a ring-shaped antenna body portion with both ends of the antenna element wire opened.

(9) In the foregoing embodiments, the case has been described in which the liquid crystal panel has a laterally long quadrilateral planar shape. However, the planar shape of the liquid crystal panel may be longitudinal quadrilateral or square, for example. In other examples, the planar shape of the liquid crystal panel may be circular or oval. Alternatively, the planar shape of the outer periphery end of the liquid crystal panel may include a combination of lines and curves.

(10) The technical features described in the above-described embodiments may be combined as appropriate.

(11) In the foregoing embodiments, the liquid crystal display device provided with the liquid crystal panel with the screen size of 30 inches to 60 inches has been described by way of example. However, the present invention is also applicable to a liquid crystal display device provided with a liquid crystal panel with a screen size of not more than 30 inches.

(12) In the foregoing embodiments, the liquid crystal display device used in an electronic device such as an information display, an electronic blackboard, a television receiver device and the like has been described by way of example. However, the present invention is also applicable to liquid crystal display devices used in electronic devices such as a PC monitor (including a desktop PC monitor and a notebook PC monitor), tablet terminals, phablet terminals, smartphones, portable telephones, and portable game machines.

(13) In the fourth embodiment, the liquid crystal display device provided with a touch panel and a cover panel has been described by way of example. However, it is also possible to adopt a configuration in which the cover panel is provided with a touch panel pattern while omitting the touch panel. It is also possible to omit the touch panel by providing the liquid crystal panel with a touch panel pattern. In this case, the cover panel may also be omitted.

(14) In the foregoing embodiments, the liquid crystal panel (VA-mode liquid crystal panel) has been described by way of example in which a pixel electrode is disposed on the array substrate side, and a common electrode is disposed on the CF substrate side, the pixel electrode and the common electrode being superposed with a liquid crystal layer interposed therebetween. It is also possible to apply the present invention to a liquid crystal display device using a liquid crystal panel (FFS-mode liquid crystal panel) of a configuration in which the pixel electrode and the common electrode are both disposed on the array substrate side, the pixel electrode and the common electrode being superposed with each other with an insulating film interposed therebetween. Further, the present invention is also applicable to a liquid crystal display device using a so-called IPS-mode liquid crystal panel.

(15) In the foregoing embodiments, the example has been described in which the color filters of the liquid crystal panel includes the three colors of red, green, and blue. The present invention is also applicable to a four-color configuration in which the color filters includes a yellow colored portion in addition to the red, green, and blue colored portions.

(16) In the foregoing embodiments, the transmitting liquid crystal display device provided with a back-light device as an external light source has been described by way of example. However, the present invention is also applicable to a reflecting liquid crystal display device which performs display using external light. In this case, the back-light device may be omitted. The present invention is also applicable to a semi-transmitting liquid crystal display device.

(17) In the foregoing embodiments, TFT has been used as a liquid crystal panel switching element. However, the present invention is also applicable to a liquid crystal display device equipped with a liquid crystal panel using a switching element other than TFT (for example, thin film diode (TFD)). Other than a liquid crystal display device equipped with a liquid crystal panel for color display, the present invention is also applicable to a liquid crystal display device equipped with a liquid crystal panel for black and white display.

(18) In the foregoing embodiments, the liquid crystal display device using a liquid crystal panel as a display panel has been described by way of example. However, the present invention is also applicable to a display device using other types of display panel, such as a plasma display panel (PDP), an organic EL panel, or an electrophoresis display panel (EPD). In these cases, the back-light device may be omitted. The present invention is also applicable to a display device using a MEMS display panel.

EXPLANATION OF SYMBOLS

10, 310: Liquid crystal display device (Transparent antenna-attached display device)
11, 311: Liquid crystal panel (Display panel)
12, 312: Transparent antenna substrate
17, 117, 217: Transparent antenna
18, 118, 218, 418, 518, 618, 718, 818, 918, 1018, 1118, 1218: Antenna body portion
18L, 118L, 418L, 518L, 618L, 918L, 1018L, 1218L: Long-side portion (Side portion)
18S, 118S, 418S, 518S, 618S, 918S, 1018S, 1218S: Short-side portion (Side portion)
19, 119, 219, 419, 519, 619, 719, 819, 919, 1019, 1119, 1219: Lead-out wire portion
20, 220: Antenna connection wiring portion
21, 421, 521, 621, 921, 1021, 1221: Antenna element wire
22: Short-circuit wire portion
23, 123, 523, 623, 723, 823, 923, 1023, 1123, 1223: Large-width portion (Line width-varying large-width portion, Inclined large-width portion)
24, 424, 524, 624, 924, 1024, 1124, 1224: First wire portion
25, 425, 525, 625, 925, 1025, 1125, 1225: Second wire portion (Constant line width large-width portion)
AA: Display region
NAA: Non-display region
MA: Magnetic field generation region
SL: Slit

The invention claimed is:

1. A transparent antenna comprising:

an antenna body portion having a ring shape and being configured to generate a magnetic field on an inner side thereof; and a plurality of the lead-out wire portions arranged side by side and led out of the antenna body portion, the plurality of lead-out wire portions including large-width portions, each of the large-width portions having a line width greater than a line width of the antenna body portion;

wherein the antenna body portion and the plurality of lead-out wire portions are configured integrally with each other as a unitary component, wherein the antenna body portion has a closed ring shape to surround a magnetic field generating region on the inner side thereof in which the magnetic field develops, wherein each of the large-width portions includes a line width-varying large-width portion having a line width that gradually increases as a distance from the antenna body portion increases, and the antenna body portion has four side portions that form a quadrilateral ring shape in a plan view, the line width-varying large-width portion is connected to one of the four side portions of the antenna body portion, and the line width-varying large-width portion includes an inclined large-width portion that is inclined with respect to a direction along one of the four side portions of the antenna body portion.

2. The transparent antenna according to claim 1, wherein the line width-varying large-width portion of one of the plurality of the lead-out wire portions which is disposed at an outermost position is configured to form an angle of not less than 14 degrees with respect to a direction perpendicular to one of the four side portions of the antenna body portion which is connected with the line width-varying large-width portion.

3. The transparent antenna according to claim 1, wherein the plurality of lead-out wire portions are entirely configured from the large-width portions.

4. A transparent antenna comprising:

an antenna body portion having a ring shape and being configured to generate a magnetic field on an inner side thereof; and a plurality of the lead-out wire portions arranged side by side and led out of the antenna body portion, the plurality of lead-out wire portions including large-width portions, each of the large-width portions having a line width greater than a line width of the antenna body portion;

wherein the antenna body portion has a closed ring shape to surround a magnetic field generating region on the inner side thereof in which the magnetic field develops;

wherein each of the large-width portions includes a line width-varying large-width portion having a line width that gradually increases as a distance from the antenna body portion increases; and wherein the antenna body portion has four side portions that form a quadrilateral ring shape in a plan view, the line width-varying large-width portion is connected to one of the four side portions of the antenna body portion, and the line width-varying large-width portion includes an inclined large-width portion that is inclined with respect to a direction along a side of the antenna body portion.

5. The transparent antenna according to claim 4, wherein the line width-varying large-width portion of one of the plurality of the lead-out wire portions which is disposed at an outermost position is configured to form an angle of not less than 14 degrees with respect to a direction perpendicular to one of the four side portions of the antenna body portion which is connected with the line width-varying large-width portion.

6. The transparent antenna according to claim 4, wherein the plurality of lead-out wire portions are entirely configured from the large-width portions.

7. A transparent antenna-attached display device comprising:

the transparent antenna including:

an antenna body portion having a closed ring shape and being configured to generate a magnetic field on an inner side thereof; and a plurality of the lead-out wire portions arranged side by side and led out of the antenna body portion, the plurality of lead-out wire portions including large-width portions, each of the large-width portions having a line width greater than a line width of the antenna body portion;

a transparent antenna substrate provided with the transparent antenna; and a display panel stacked on the transparent antenna substrate, the display panel including a display region configured to display an image and a non-display region circumscribing the display region, wherein the transparent antenna is disposed over the display region.

8. The transparent antenna-attached display device according to claim 7, wherein the transparent antenna substrate is provided with a plurality of antenna connecting wire portions disposed over the non-display region and connected to the plurality of lead-out wire portions.

9. The transparent antenna-attached display device according to claim 8, wherein the transparent antenna is configured such that the antenna body portion includes a plurality of antenna element wires, and the plurality of the lead-out wire portions are individually connected to respective ends of the plurality of antenna element wires, and each of the plurality of antenna connecting wire portions includes a short-circuit wire portion which short-circuits two lead-out wire portions connected to respective ends of mutually different antenna element wires.

* * * * *